US012376630B2

(12) United States Patent
Robell

(10) Patent No.: US 12,376,630 B2
(45) Date of Patent: Aug. 5, 2025

(54) SMART CLOTHING SYSTEM AND METHODS

(71) Applicant: Glenn Robell, Peoria, AZ (US)

(72) Inventor: Glenn Robell, Peoria, AZ (US)

( * ) Notice: Subject to any disclaimer, the term of this patent is extended or adjusted under 35 U.S.C. 154(b) by 0 days.

(21) Appl. No.: 18/923,204

(22) Filed: Oct. 22, 2024

(65) Prior Publication Data

US 2025/0040629 A1 Feb. 6, 2025

Related U.S. Application Data

(63) Continuation-in-part of application No. 18/513,551, filed on Nov. 18, 2023, now Pat. No. 12,121,081, which is a continuation of application No. 18/105,831, filed on Feb. 4, 2023, now Pat. No. 11,819,067.

(51) Int. Cl.
*A41D 13/00* (2006.01)

(52) U.S. Cl.
CPC ..... *A41D 13/0015* (2013.01)

(58) Field of Classification Search
CPC .... A41D 13/0015; A41D 27/08; A41D 29/00; A41D 1/04; A41D 1/002
See application file for complete search history.

(56) References Cited

U.S. PATENT DOCUMENTS 10,244,802 B2 * 4/2019 Gibson ..... A41D 27/08
11,819,067 B1 * 11/2023 Robell ..... A41D 1/002
12,121,081 B2 * 10/2024 Robell ..... A41D 1/002
2008/0056508 A1 * 3/2008 Pierce ..... H04R 5/02 381/87
2009/0007310 A1 * 1/2009 Armour ..... G09F 21/02 2/244
2012/0284894 A1 * 11/2012 Brown ..... A41D 1/04 2/69
2014/0180869 A1 * 6/2014 Kurucza ..... A41D 1/02 2/93
2014/0189929 A1 * 7/2014 Gooch ..... A41D 27/08 2/69

(Continued)

FOREIGN PATENT DOCUMENTS

WO WO-2017040724 A1 * 3/2017 ..... A41D 1/002
WO WO-2017210514 A1 * 12/2017 ..... A41D 1/002

(Continued)

*Primary Examiner* — Tajash D Patel
(74) *Attorney, Agent, or Firm* — Edmond DeFrank

(57) ABSTRACT

The embodiments disclose a smart clothing system including a piece of smart clothing having fabric, a plurality of sensors integrated with the piece of smart clothing and coupled to the fabric of the smart clothing, a plurality of actuation devices integrated with the piece of smart clothing and coupled to the sensors of the smart clothing, a mobile device configured to wirelessly communicate via a Bluetooth® protocol with the plurality of sensors and the plurality of actuation devices of the smart clothing with bidirectional send and receive digital signals, and a smart application operating on the mobile device and having a voice command device, wherein the smart application is configured to provide status data of the plurality of sensors and the plurality of actuation devices, and the voice command device is configured to control the plurality of sensor and the plurality actuation devices.

20 Claims, 19 Drawing Sheets

(56) References Cited

U.S. PATENT DOCUMENTS

| | | | | |
|---|---|---|---|---|
| 2016/0174614 | A1* | 6/2016 | Kimmet | A41B 1/08 2/116 |
| 2017/0108878 | A1* | 4/2017 | Krispin | H04B 1/385 |
| 2017/0360128 | A1* | 12/2017 | Brinkmann | A41D 13/0015 |
| 2018/0027889 | A1* | 2/2018 | Frost | A41D 3/00 |
| 2018/0098587 | A1* | 4/2018 | Moore | A43B 23/0205 |
| 2024/0260682 | A1* | 8/2024 | Goncalves | A41D 1/002 |

FOREIGN PATENT DOCUMENTS

| | | | | |
|---|---|---|---|---|
| WO | WO-2020041228 | A1 * | 2/2020 | A41D 1/005 |
| WO | WO-2022146602 | A1 * | 7/2022 | A41C 3/0021 |

* cited by examiner

SMART CLOTHING SYSTEM AND METHODS

CROSS-REFERENCE TO RELATED APPLICATIONS

This Patent Applications is a Continuation-in-part and claims priority to the United States Patent Applications entitled: "MULTI-TEAM SPORTS JERSEY", U.S. Ser. No. 18/513,551 filed on Nov. 18, 2023, by Glenn Robell, which is a continuation of the United States Patent Applications entitled: "MULTI-TEAM SPORTS JERSEY", U.S. Ser. No. 18/105,831 filed on Feb. 4, 2023, by Glenn Robell, U.S. Pat. No. 11,819,067 issued on Nov. 1, 2023, the U.S. Patent Applications being incorporated herein by reference.

BACKGROUND

Many sports fans are supporters of more than one team and more than one sport. However, a sports jersey shirt typically only shows one team in a single sport. Sports fans enjoy sharing their enthusiasm with others in all types of weather conditions. What they are missing is a multi-team sports jersey shirt that displays their enthusiasm for the multiple teams and sports and is suitable for any type of weather conditions.

DETAILED DESCRIPTION OF THE INVENTION

Figure 1:
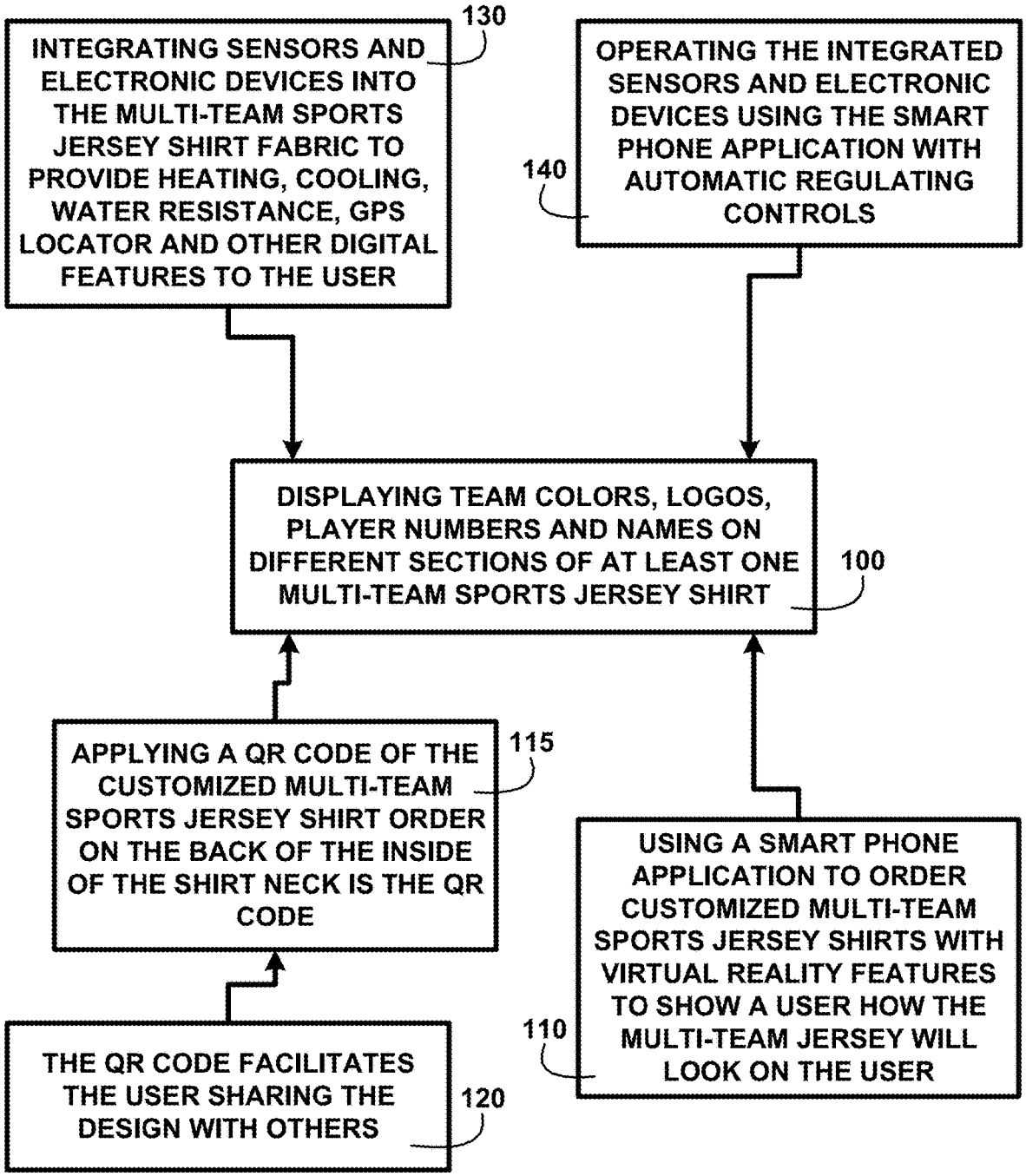
FIG. 1 shows a block diagram of an overview flow chart of a multi-team sports jersey of one embodiment.

In a following description, reference is made to the accompanying drawings, which form a part hereof, and which are shown by way of illustration a specific example in which the invention may be practiced. It is to be understood that other embodiments may be utilized and structural changes may be made without departing from the scope of the present invention.

It should be noted that the descriptions that follow, for example, in terms of smart clothing are described for illustrative purposes and the underlying system can apply to any number and multiple types of clothing, such as shirts, jerseys, hats, pants, jackets, shoes, socks, gloves, and any other type of clothing for humans, wild animals or pet animals. In one embodiment, smart clothing has smart textiles that can be coupled and connected to suitable wearable electronics that include wearable sensors, wearable actuators and wearable controllers integrated with the smart fabrics or external wearables, such as smart glasses, smart watches, smart bracelets, smart jewelry smart contact lenses, and similar smart wearables. In another embodiment, the smart clothing has wearable electronics that include wearable sensors, wearable actuators and wearable controllers that are connected in a suitable wireless or wired manner to the clothing. The sensors, actuators and controllers can be connected directly to the fabric and/or the smart clothing.

The wearable technology, such as the sensors and actuators, can be wirelessly coupled to, physically attached to, integrated within, or embedded within the clothing and fabrics to allow the wearable technology to interact with a user of the smart clothing or the user's environment to monitor the health of the user, communicate with the user or others near the user, or enhance the user's experience with himself/herself or others near the user. Smart clothing can be integrated with illuminating fiber optic lights, small low-powered LED lights, speakers, haptics devices, vibration devices, and the like. In one embodiment, the illuminating smart clothing can be configured to include lights that have multiple colors.

The sensors used in the smart clothing of the present invention include but is not limited to, sensor systems of wired and wireless sensors including vision and imaging sensors, audible sensors, temperature sensors, radiation sensors, proximity sensors, gyroscopic sensors, directional sensors, pressure sensors, position sensors (GPS sensors, NFC sensors, etc.), photoelectric sensors, particle sensors, motion sensors, metal sensors, level sensors, leak sensors, humidity sensors, gas and chemical sensors, force sensors, flow sensors, flaw sensors, flame sensors, electrical sensors, contact sensors, non-contact sensors, vital signs sensors, including, but not limited to, body temperature, heart rate, respiratory rate, blood pressure, oxygen saturation, dehydration and others. Wherein the sensors may be embedded in another object or device. The sensors may be configured as a wearable or attachable to an object or person to monitor. A monitoring processor configured to wirelessly receive sensor data.

It should be noted that the descriptions that follow, for example, in terms of a multi-team sports jersey are described for illustrative purposes and the underlying system can apply to any number and multiple types of sports-related garments. In one embodiment of the present invention, the multi-team sports jersey can be configured using multiple team names. The multi-team sports jersey can be configured to include team colors and can be configured to include player numbers using the present invention.

FIG. 1 shows a block diagram of an overview flow chart of a multi-team sports jersey of one embodiment. FIG. 1 shows a multi-team sports jersey displaying team colors, logos, player numbers, and names on different sections of at least one multi-team sports jersey shirt 100. Using a smartphone app to order customized multi-team sports jersey shirts with virtual reality features to show a user how the multi-team jersey will look on the user 110. Applying a QR code of the customized multi-team sports jersey shirt order on the back of the inside of the shirt neck is the QR code 115. The QR code facilitates the user sharing the design with others 120. Integrating sensors and electronic devices into the multi-team sports jersey shirt fabric to provide heating, cooling, water resistance, GPS locator, and other digital features to the user 130. Operating the integrated sensors and electronic devices using the smartphone application with automatic regulating controls 140 of one embodiment.

Figure 2:
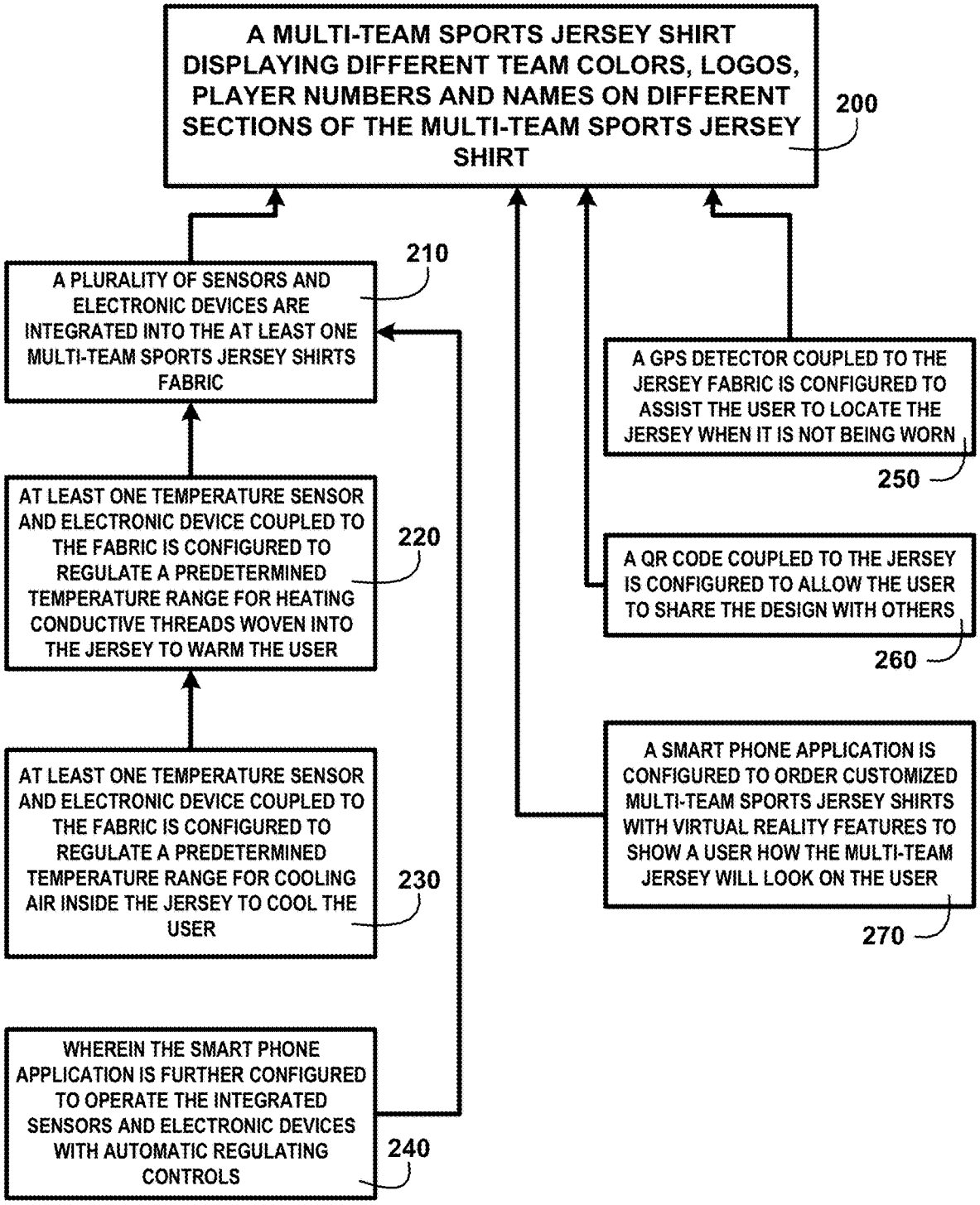
FIG. 2 shows a block diagram of an overview of a plurality of sensors and electronic devices of one embodiment.

FIG. 2 shows a block diagram of an overview of a plurality of sensors and electronic devices of one embodiment. FIG. 2 shows a multi-team sports jersey shirt displaying different team colors, logos, player numbers, and names on different sections of the multi-team sports jersey shirt 200. At least one multi-team sports jersey clothing fabric with color treatments for sports jersey clothing patterns with different sections in different sports team color selections. Multi-team sports jersey clothing fabric with hydrophobic treatment for water resistance.

A plurality of sensors and electronic devices are integrated into at least one multi-team sports jersey shirt fabric 210. At least one temperature sensor and an electronic device coupled to the fabric are configured to regulate a predetermined temperature range for heating conductive threads woven into the jersey to warm the user 220.

At least one temperature sensor and an electronic device coupled to the fabric are configured to regulate a predetermined temperature range for cooling air inside the jersey to cool the user 230. The smartphone app is further configured to operate the integrated sensors and electronic devices with automatic regulating controls 240. A plurality of sensors is integrated into smart fibers woven into the first and second sports jersey sections.

A GPS detector coupled to the jersey fabric is configured to assist the user in locating the jersey when it is not being worn 250. A QR code coupled to the jersey is configured to allow the user to share the design with others 260. A smartphone app configured to order customized multi-team sports jersey shirts with virtual reality features to show a user how the multi-team jersey will look on the user 270 of one embodiment.

Figure 3:
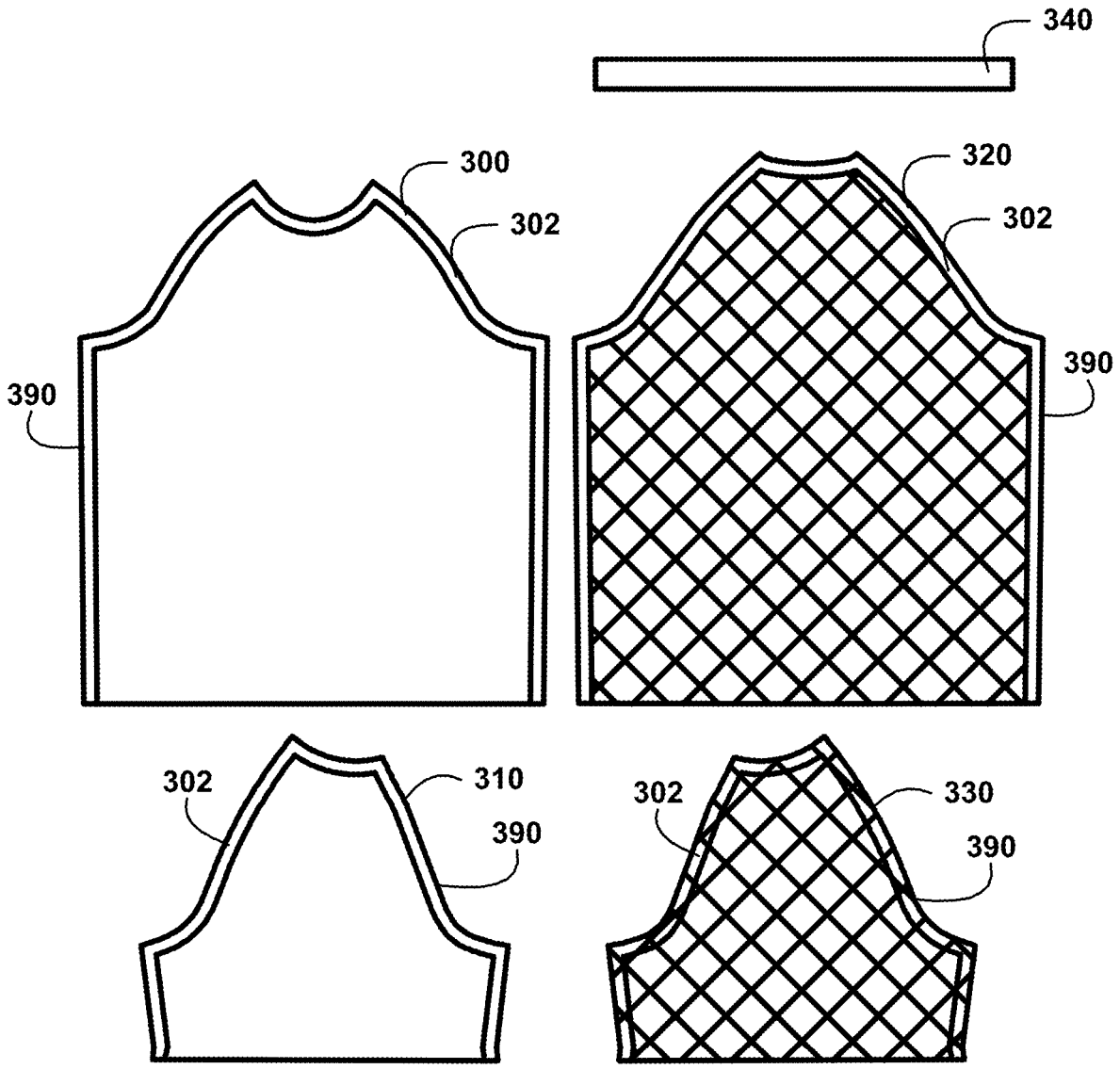
FIG. 3 shows for illustrative purposes only an example of a multi-team sports jersey clothing pattern of one embodiment.

FIG. 3 shows for illustrative purposes only an example of a multi-team sports jersey clothing pattern of one embodiment. FIG. 3 shows a multi-team sports jersey shirt front 300 and multi-team sports jersey shirt right sleeve 310 patterns. Seams are sewn using a raw edge 302 of the cut sections. The front panel and right sleeve will display the first team selected by the user. Also seen in FIG. 3 is the multi-team sports jersey shirt back panel 320 and multi-team sports jersey shirt left sleeve 330. The back and left sleeves will display a second team selected by the user. The multi-team sports jersey shirt neckpiece 340 joins the front and back of the shirt at the neckline. Stitching is made along the seams 390 of the pattern. A stitched seam separates the first and second sections of the sports jersey from one another of one embodiment.

Figure 4A:
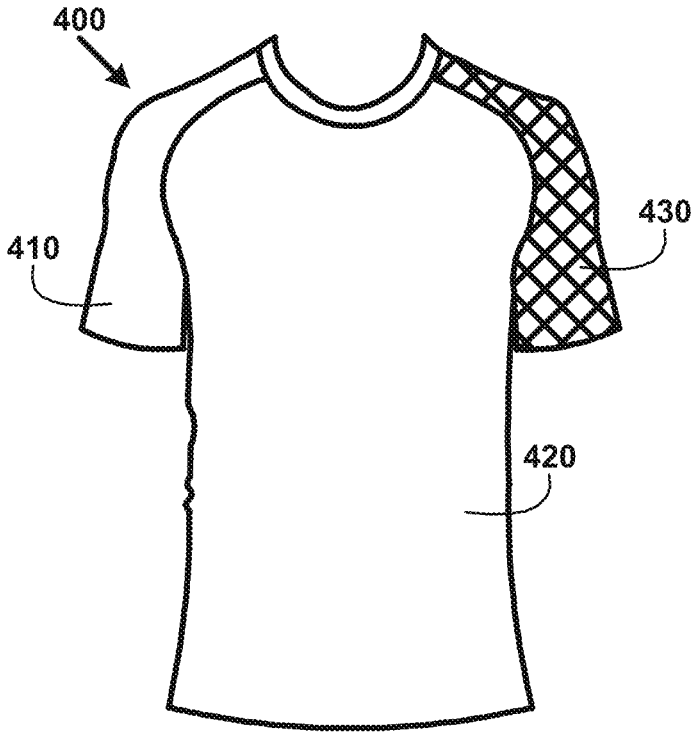
FIG. 4A shows for illustrative purposes only an example of a multi-team sports jersey shirt in front of one embodiment.

FIG. 4A shows for illustrative purposes only an example of a multi-team sports jersey shirt in front of one embodiment. FIG. 4A shows the multi-team sports jersey shirt front sewn 400 including the front panel 420 and right sleeve 410 that will display first-team colors, players, and other first-team information. The left sleeve 430 will display at least a second team color of one embodiment.

The front and back sections of the multi-team sports jersey shirt can also include the commemorative insignia of special sporting events. For example, the Super Bowl football championship with Roman numerals i.e., "Super Bowl LVI" and the city where the game is being played with the name of the stadium. In one embodiment, the front section would display the Super Bowl commemorative insignia, and the back section the name and insignia of the team the user is cheering for to win. A commemorative section that includes championship commemorative insignia with indicia of a year of a championship event, wherein the first and second player numbers and the championship commemorative insignia are stitched as appliques. Other special sports events include the Stanley Cup Finals hockey championship, World Series baseball championship, World Cup soccer championship, NBA Finals basketball championship, and other special sports events.

Other special sports events can include College Bowl football games. For example, the Rose Bowl, the Army-Navy NCAA football game, Fiesta Bowl, and many others. The Little League Baseball World Series where the front section displays the commemorative insignia of the series, and the back section displays the user's hometown little league team.

In another embodiment, the multi-team sports jersey shirt displays on the front section the Olympic Games five-ring Olympic insignia, city, and year of the games. This would include the summer and winter Olympic games. On the back section, particular sporting competitions can be displayed. For example, some of the summer competitions i.e., the 100*m* sprint, Gymnastics, Weightlifting, and other competitions the user is interested in watching. The Winter Olympics competitions include for example, Speed Skating, Ski Jumping, Curling, Luge, and other competitions the user is interested in watching. Other special sports events the user may wish to support include the Special Olympics, local Little League Baseball events and teams, and Pop Warner Football Super Bowl of one embodiment.

Figure 4B:
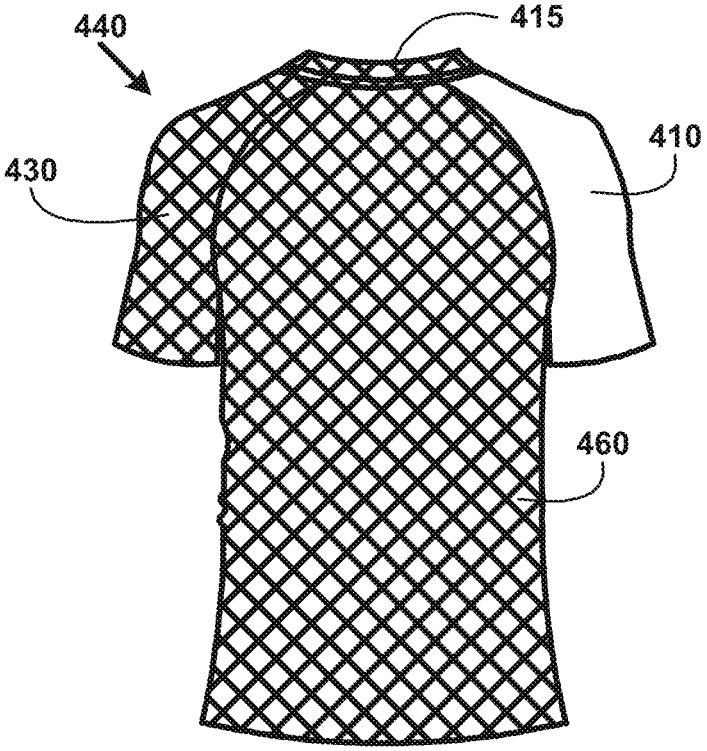
FIG. 4B shows for illustrative purposes only an example of a multi-team sports jersey shirt back of one embodiment.

FIG. 4B shows for illustrative purposes only an example of a multi-team sports jersey shirt back of one embodiment. FIG. 4B shows the multi-team sports jersey shirt back sewn 440 including the left sleeve 430, back panel 460, and right sleeve 410. Applying a QR code of the customized multi-team sports jersey shirt order on the back of the inside of the shirt neck is the QR code 415. The back panel 460 and the left sleeve 430 display a second team color, player, and other second-team information. The right sleeve 410 will display at least a first-team color of one embodiment.

Figure 5A:
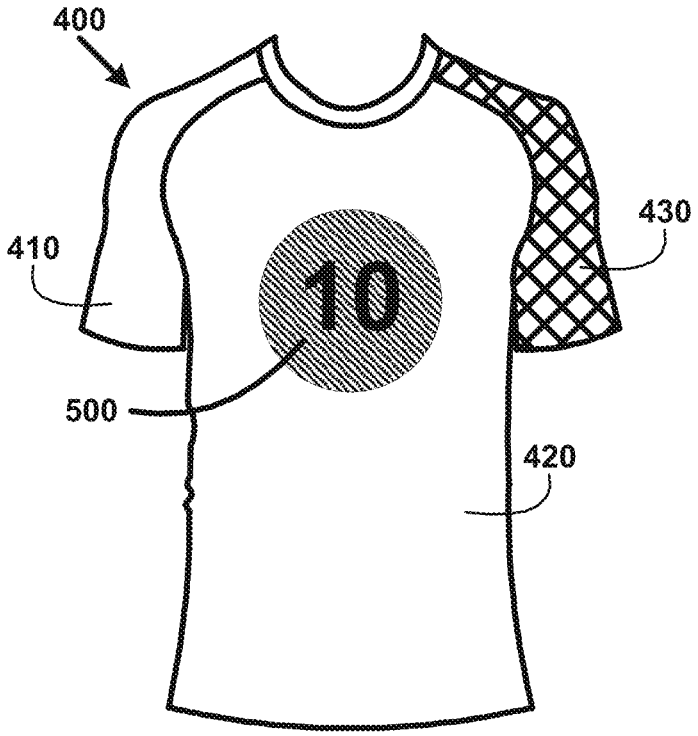
FIG. 5A shows for illustrative purposes only an example of a multi-team sports jersey shirt front with a player number of one embodiment.

FIG. 5A shows for illustrative purposes only an example of a multi-team sports jersey shirt front with a player number of one embodiment. FIG. 5A shows the multi-team sports jersey shirt front sewn 400 including the right sleeve 410 and front panel 420 displaying a first player number 500. A second team color will be displayed on the left sleeve 430.

A sports jersey pattern seam stitching protocol is configured to create a vivid contrast in two different team colors. A fabric of each section seam is joined in complementary folds with interior stitching thread that is not seen which creates a clear demarcation of the two colors. Stitching of seams of the front section panel to the right sleeve section and the back section panel to the left sleeve section are each made with team color-matching colored thread.

Section seam stitching on one fabric uses threads that match the color of the fabric. Stitching of appliques of player numbers, team names, and commemorative insignia of special sporting events are stitched to the chosen sports jersey pattern section with thread matching the underlying fabric color. Multi-team sports jersey pattern sections in different user sizes for different clothing styles including jersey shirts, hoodies, long and short-sleeved shirts, sweatpants, shorts, hats, and other clothing styles of one embodiment.

Figure 5B:
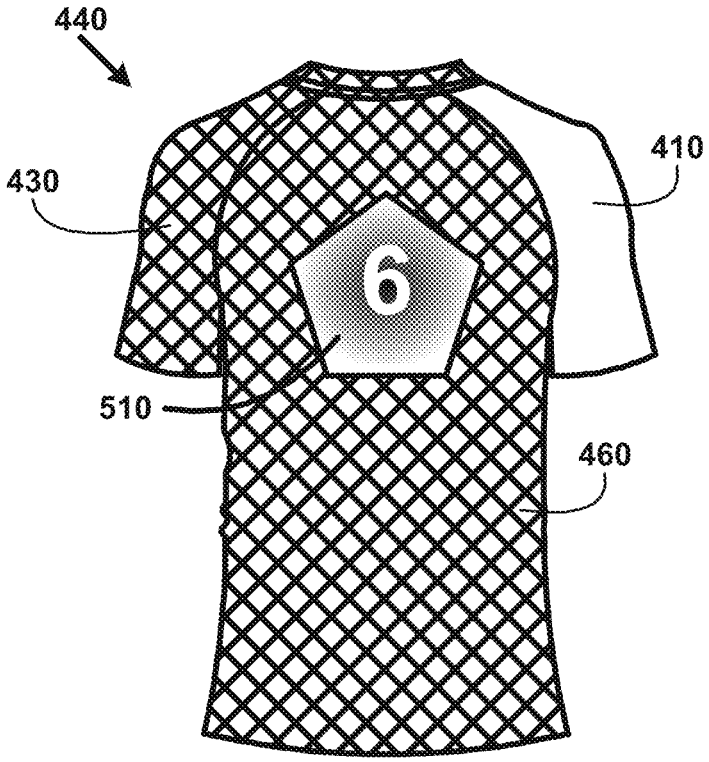
FIG. 5B shows for illustrative purposes only an example of a multi-team sports jersey shirt back with a player number of one embodiment.

FIG. 5B shows for illustrative purposes only an example of a multi-team sports jersey shirt back with a player number of one embodiment. FIG. 5B shows the multi-team sports jersey shirt back sewn 440 including the left sleeve 430 and back panel 460 displaying the second team color and a second player number 510. A first-team color is displayed on the right sleeve 410 of one embodiment.

Figure 6A:
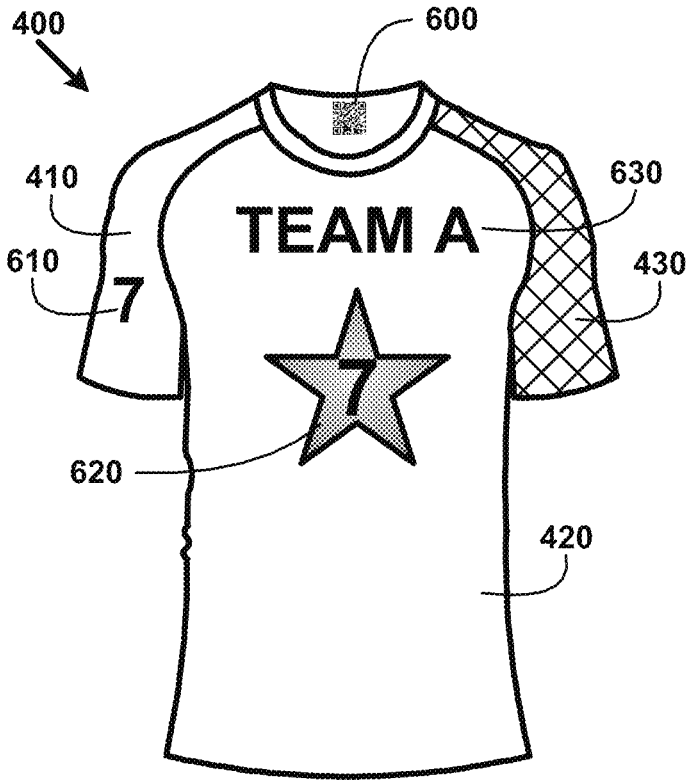
FIG. 6A shows for illustrative purposes only an example of a multi-team sports jersey shirt front with player number, team name, and logo of one embodiment.

FIG. 6A shows for illustrative purposes only an example of a multi-team sports jersey shirt front with player number, team name, and logo of one embodiment. FIG. 6A shows the multi-team sports jersey shirt front sewn 400 including the right sleeve 410, front panel 420, and left sleeve 430. The front panel 420 displays the first team color, first player number 610, Team A logo 620, and Team A 630 name. On the back of the inside of the shirt neck is the QR code 600 facilitating the user to share the pattern with another person. In one embodiment, the team logo, name, colors, and other identifying symbols are represented of one embodiment.

Figure 6B:
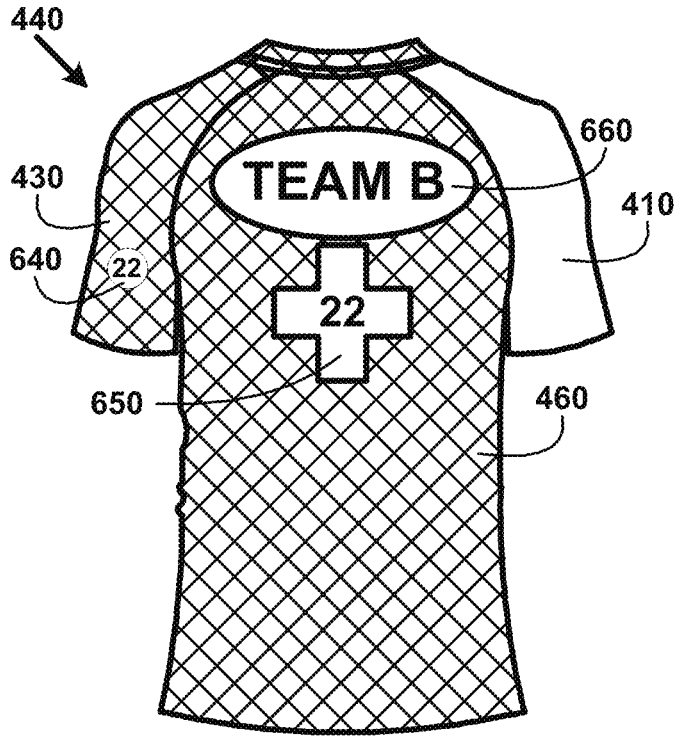
FIG. 6B shows for illustrative purposes only an example of a multi-team sports jersey shirt back with player number, team name, and logo of one embodiment.

FIG. 6B shows for illustrative purposes only an example of a multi-team sports jersey shirt back with player number, team name, and logo of one embodiment. FIG. 6B shows a multi-team sports jersey shirt back sewn 440 including the left sleeve 430 and back panel 460 displaying the second team. The right sleeve 410 is displaying at least the first team color. The left sleeve 430 is displaying the second player number 640. The back panel 460 displays a Team B logo 650 and Team B 660 name. In one embodiment, a sports team insignia refers to a combination of a sports team logo, team colors, a player number, and any other symbols identifying the sports team of one embodiment.

Figure 7:
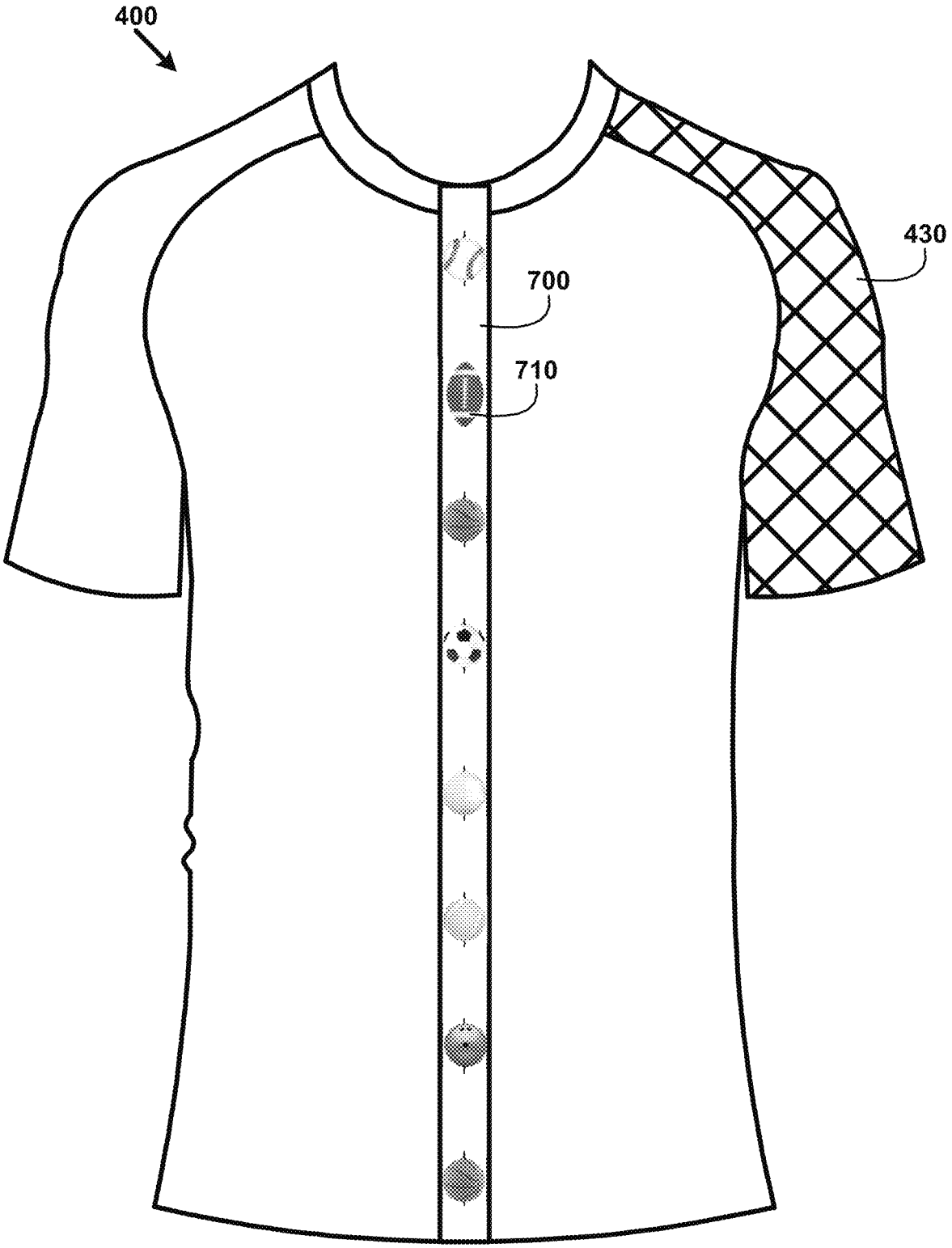
FIG. 7 shows for illustrative purposes only an example of a multi-team sports jersey shirt front with sports equipment buttons of one embodiment.

FIG. 7 shows for illustrative purposes only an example of a multi-team sports jersey shirt front with sports equipment buttons of one embodiment. FIG. 7 shows the multi-team sports jersey shirt front sewn 400, the left sleeve 430, and the right sleeve 410. FIG. 7 shows a conductive thread buss 700 to conduct power to the sports button rechargeable battery compartment 710. The conductive thread buss 700 distributes power to the individual sports button rechargeable battery compartment 710 when recharging. The conductive thread buss 700 conducts power to conductive threads to energize the heating and cooling functions.

A thermal conductive thread is interwoven into the fabric of the clothing and configured to generate heat with power from a plurality of rechargeable batteries when ambient temperatures are cold. A micro-tubing integrated into the fabric of the clothing is configured to convey with a micro-pump a cooling fluid that absorbs body heat and dissipates the heat outside of the clothing to cool the user when ambient temperatures are hot. At least one micro-thermostat with adjustable temperature settings coupled to the thermal conductive thread heating system and the micro-tubing cooling system configured to regulate clothing temperatures within a predetermined range set by the user with a wirelessly coupled smartphone app of one embodiment.

Figure 8A:
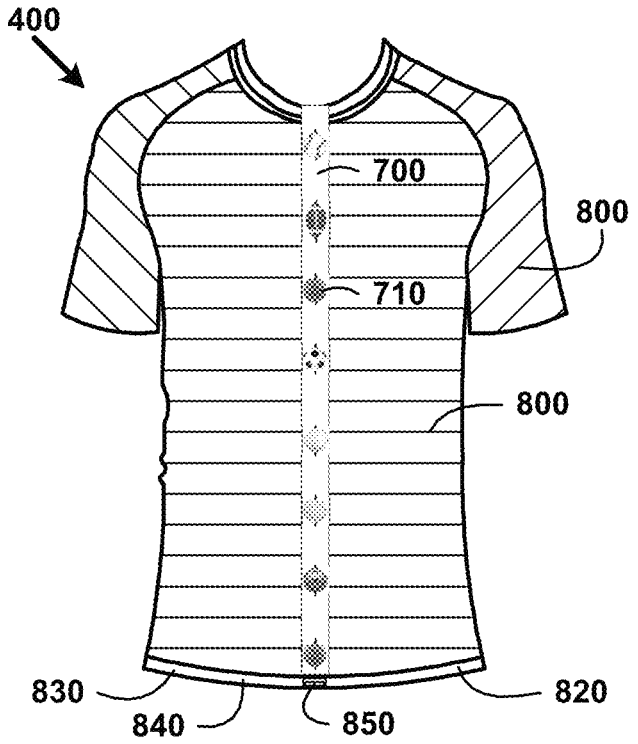
FIG. 8A shows for illustrative purposes only an example of a multi-team sports jersey shirt front with sports equipment buttons and conductive threads of one embodiment.

FIG. 8A shows for illustrative purposes only an example of a multi-team sports jersey shirt front with sports equipment buttons and conductive threads of one embodiment. FIG. 8A shows the multi-team sports jersey shirt front sewn 400 with the conductive thread buss 700 and plurality of sports button rechargeable battery compartment 710 connected to the buss. The conductive thread buss 700 is coupled to a USB recharging port 850 for recharging the plurality of sports button rechargeable battery compartment 710 batteries. In one embodiment, the threads are infrared fiber heating elements. In another embodiment, the sports button rechargeable batteries are lithium-ion batteries. In yet another embodiment, the multi-team sports jersey shirt and other clothing have a cotton insulation layer liner.

Each conductive thread 800 is connected to the temperature regulator 830. The temperature regulator 830 regulates the voltage and amperage to raise and lower temperatures of the multi-team sports jersey shirt within a temperature range set by the user with the smartphone app. A communication device 820 coupled to the bottom cuff of the shirt receives signals from the smartphone app. The communication device 820 also transmits signals from the GPS locator 840 in both WIFI and cellular to send GPS location capability to capture coordinates of the multi-team sports jersey shirt for user locating purposes of one embodiment.

Figure 8B:
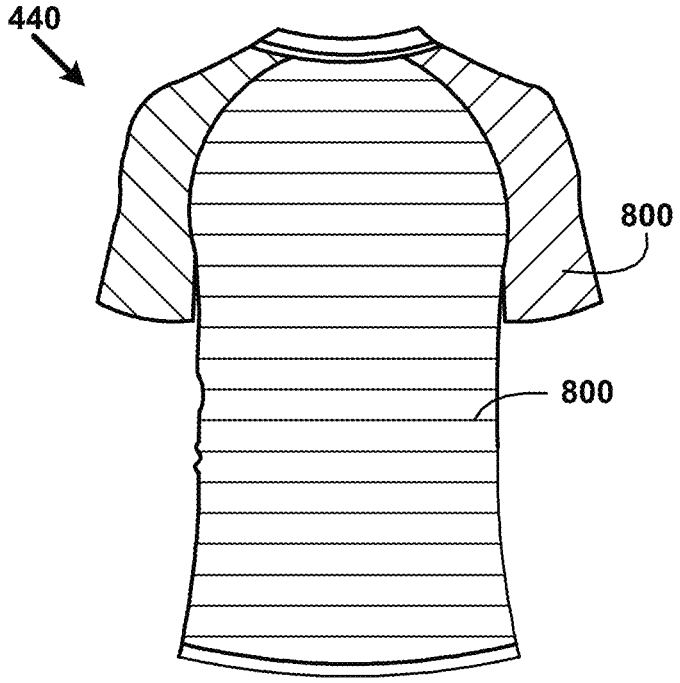
FIG. 8B shows for illustrative purposes only an example of a multi-team sports jersey shirt front with conductive threads of one embodiment.

FIG. 8B shows for illustrative purposes only an example of a multi-team sports jersey shirt front with conductive threads of one embodiment. FIG. 8B shows the multi-team sports jersey shirt back sewn 440 with a thermal conductive thread 800 interwoven into the fabric. In one embodiment, the thermal conductive thread 800 includes infrared fiber heating elements. In another embodiment, the fabric includes Polyamide fiber threads interwoven with the thermal conductive thread 800. The temperature of the shirt is regulated to warm the user in cold conditions and cool the user in hot conditions.

In yet another embodiment, the multi-team sports jersey shirt and other clothing include micro-tubing sewn into the fabric to convey with a micro pump a cooling fluid that absorbs body heat and dissipates the heat outside of the clothing with a micro-fan therein cooling the fluid to absorb heat repeatedly. A micro-thermostat with adjustable temperature settings regulates the cooling temperature within a predetermined range set by the user with the wirelessly coupled smartphone app on the user's mobile device of one embodiment.

Figure 9A:
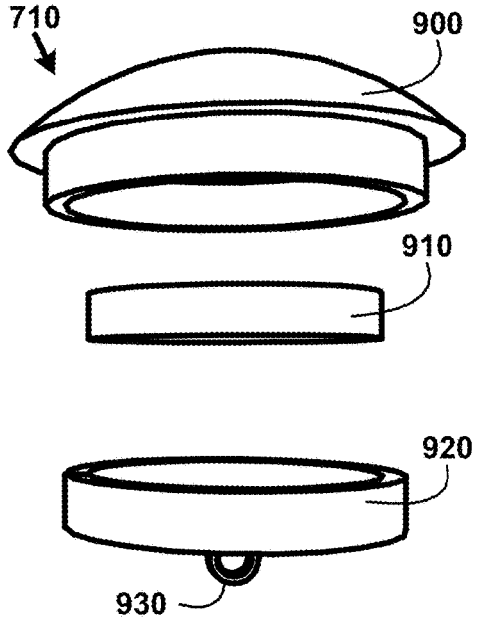
FIG. 9A shows for illustrative purposes only an example of sports button components of one embodiment.

FIG. 9A shows for illustrative purposes only an example of sports button components of one embodiment. FIG. 9A shows the elements of the sports button rechargeable battery compartment 710 including the sports equipment cover 900. The sports equipment covers 900 components including, for example, a baseball, football, soccer ball, tennis ball, and other sports equipment. Also showing is a rechargeable battery 910, a battery receiver 920, and a conductive connection 930 of one embodiment.

Figure 9B:
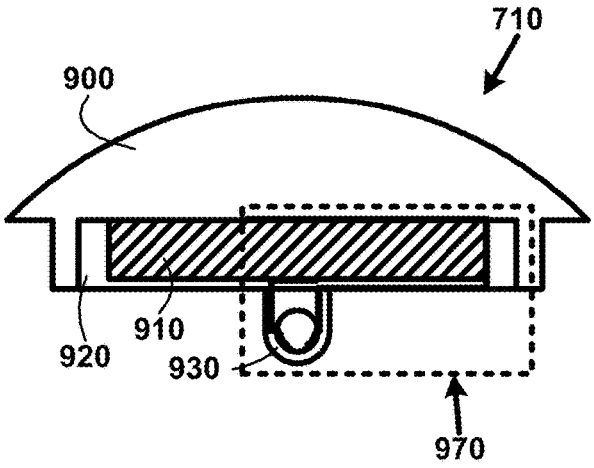
FIG. 9B shows for illustrative purposes only an example of a sports button assembly power supply of one embodiment.

FIG. 9B shows for illustrative purposes only an example of a sports button assembly power supply of one embodiment. FIG. 9B shows the sports button rechargeable battery compartment 710 with the elements connected in a power conductive mode. The sports equipment cover 900 is interchangeable with the battery receiver 920. A user can select multiples of a single or another number of different sports equipment that cover 900 units. The rechargeable battery 910 installs into the battery receiver 920 wherein the conductive connection 930 is sewn to the conductive thread buss 700 of FIG. 7. The circuit connections are shown in a blow-up 970 in FIG. 9C of one embodiment.

Figure 9C:
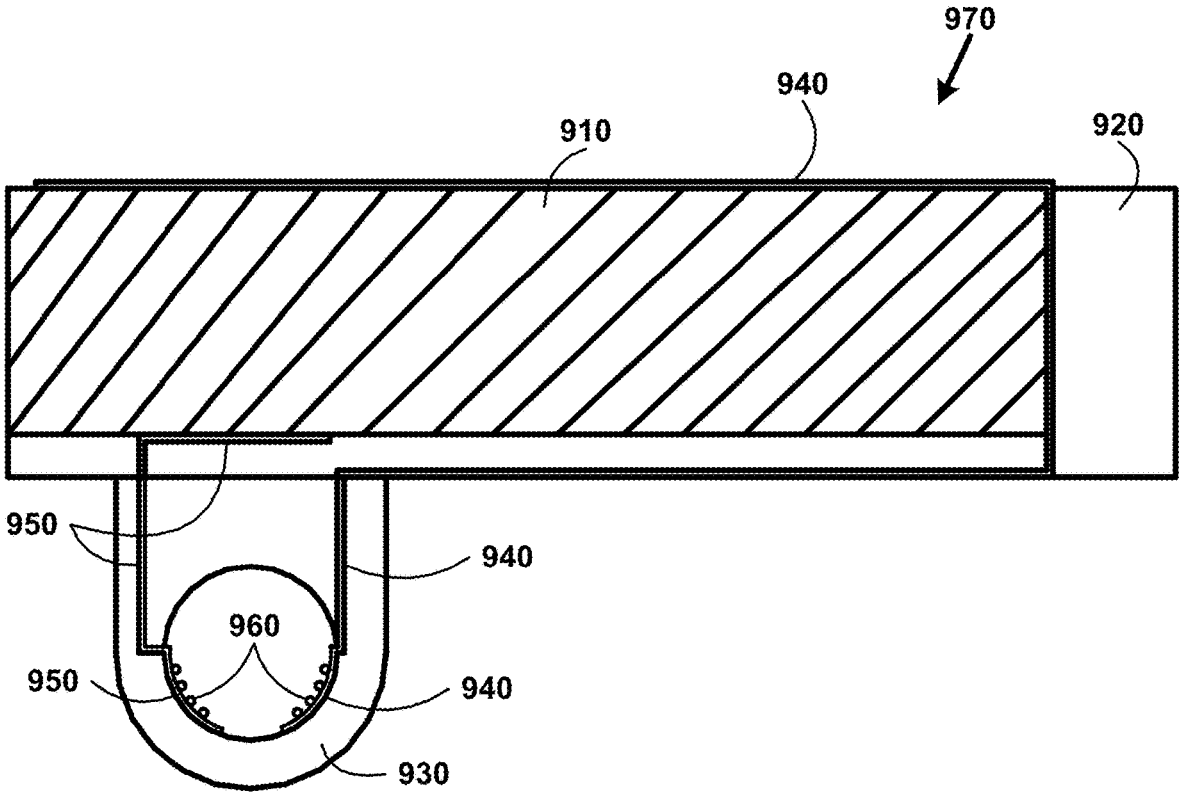
FIG. 9C shows for illustrative purposes only an example of a sports button rechargeable pattern and wiring of one embodiment.

FIG. 9C shows for illustrative purposes only an example of a sports button rechargeable pattern and wiring of one embodiment. FIG. 9C shows the blow-up 970 of the circuit connections showing the rechargeable battery 910 set into the battery receiver 920. The conductive connection 930 is the structure with which the buttons are attached to the conductive thread buss 700 of FIG. 7. A battery-positive conductor 940 from the top of the rechargeable battery 910 is routed to the conductive connection 930. A battery negative conductor 950 from the bottom of the rechargeable battery 910 is routed to the conductive connection 930 on the opposite side to the battery positive conductor 940 circuit conductors.

The conductive connection 930 is used for a sewn connection using conductive threads connecting to the battery conductors 960 to complete circuits for power conduction to and from the plurality of the rechargeable battery 910 units. Other electronic devices, including piezo electrical sources, also connect to the plurality of the rechargeable battery 910 units through the conductive thread buss 700 of FIG. 7 extended in the bottom cuff of the shirt of one embodiment.

Figure 10:
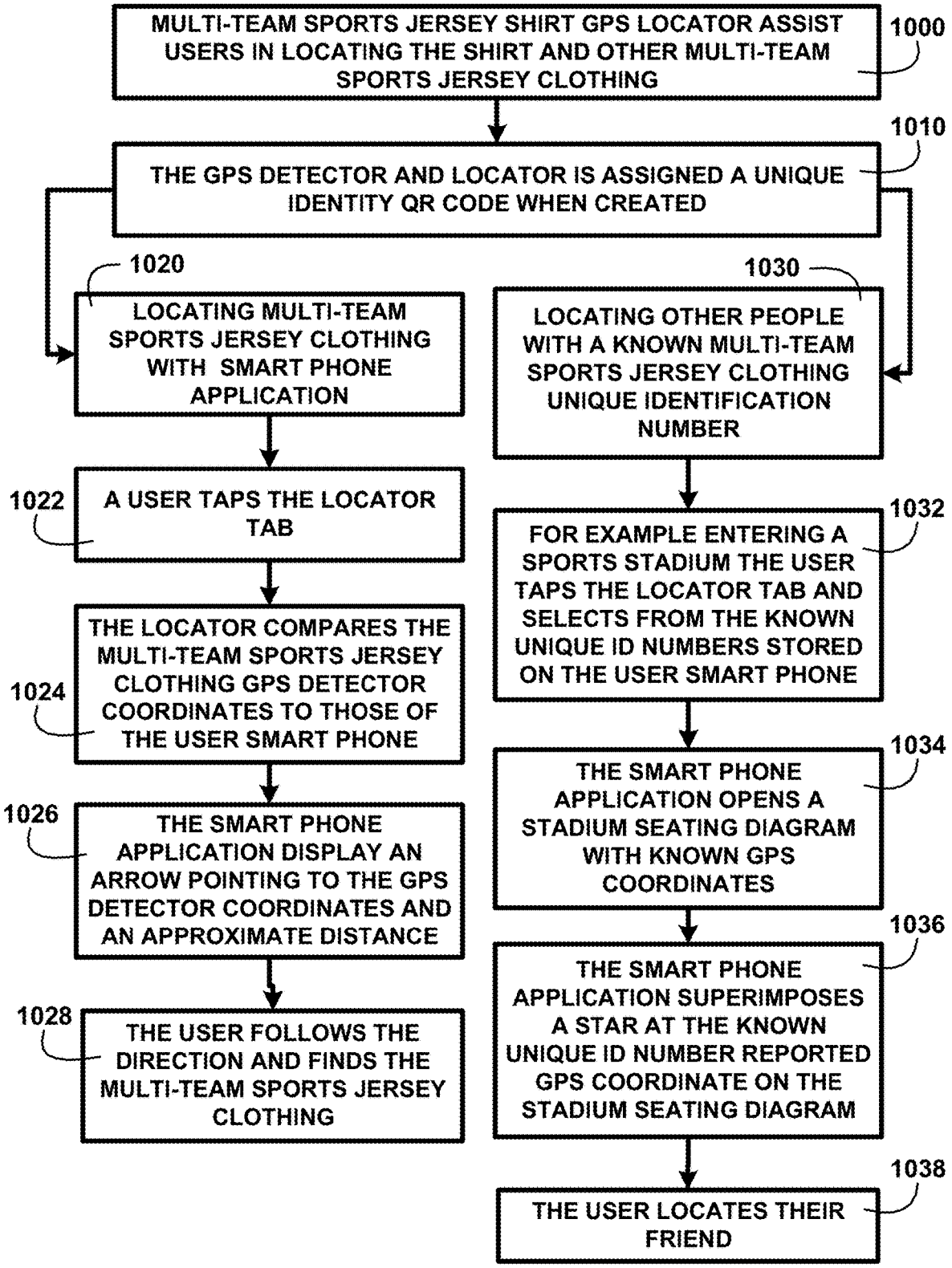
FIG. 10 shows a block diagram of an overview of a multi-team sports jersey shirt GPS locator of one embodiment.

FIG. 10 shows a block diagram of an overview of a multi-team sports jersey shirt GPS locator of one embodiment. FIG. 10 shows the multi-team sports jersey shirt GPS locator assists users in locating the shirt and other multi-team sports jersey clothing 1000. The GPS detector and locator are assigned a unique identity QR code when created 1010. Locating multi-team sports jersey clothing with smartphone app 1020. A user taps the locator tab 1022. The locator compares the multi-team sports jersey clothing GPS detector coordinates to those of the user smartphone 1024. The smartphone app displays an arrow pointing to the GPS detector coordinates and an approximate distance 1026. The user follows the direction and finds the multi-team sports jersey clothing 1028.

Locating other people with a known multi-team sports jersey clothing with a unique identification number 1030. For example, when entering a sports stadium the user taps the locator tab and selects from the known unique ID numbers stored on the user's smartphone 1032. The smartphone app opens a stadium seating diagram with known GPS coordinates 1034. The smartphone app superimposes a star at the known unique ID number reported GPS coordinate on the stadium seating diagram 1036. The user locates their friend 1038 of one embodiment.

Figure 11:
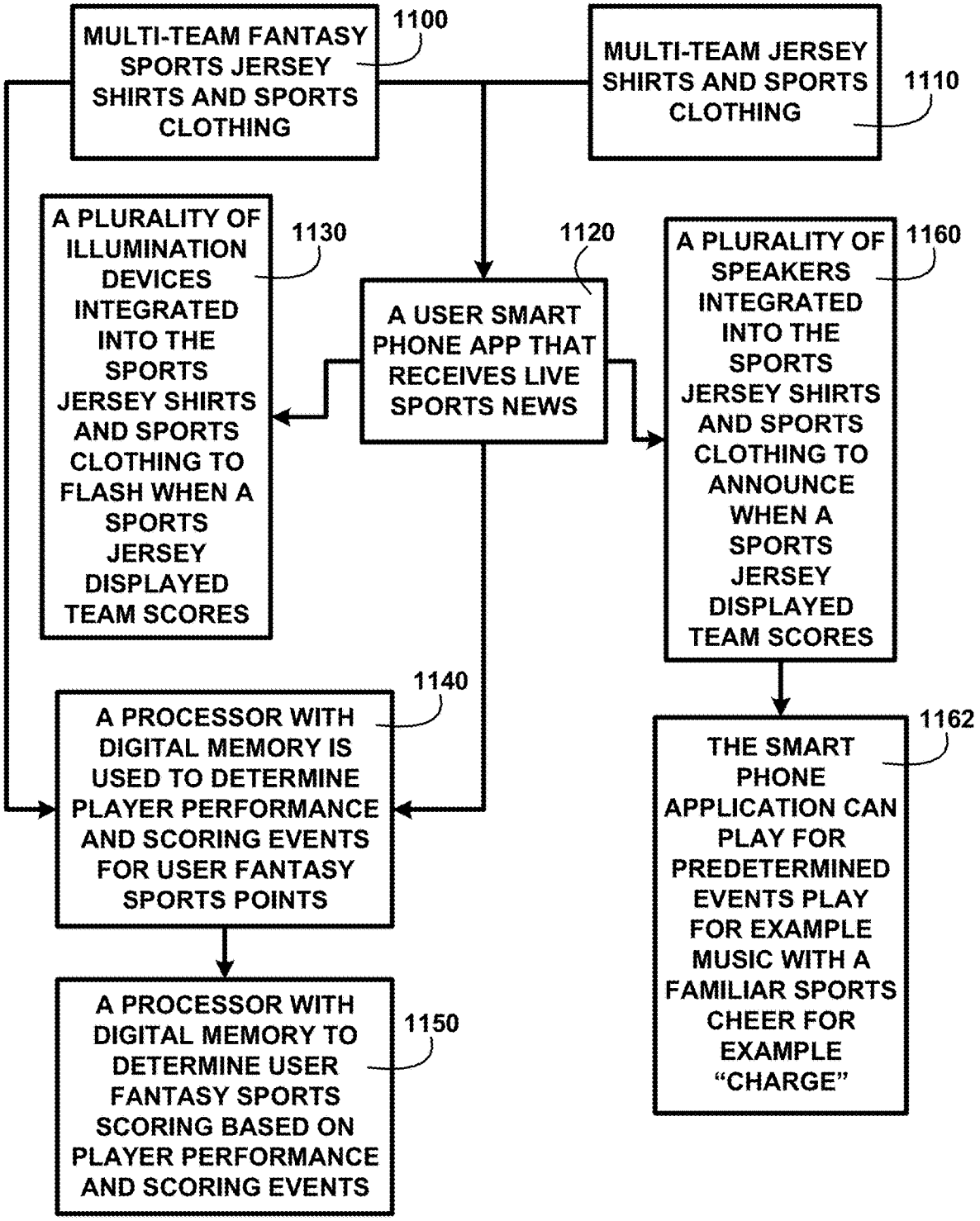
FIG. 11 shows a block diagram of an overview of multi-team fantasy sports jersey shirts and clothing of one embodiment.

FIG. 11 shows a block diagram of an overview of multi-team fantasy sports jersey shirts and clothing of one embodiment. FIG. 11 shows multi-team fantasy sports jersey shirts and sports clothing 1100 in addition to multi-team jersey shirts and sports clothing 1110. In one embodiment, a multi-team fantasy sports jersey shirt is configured, for example, with a first fantasy player picking a name and the user's fantasy team name on the front panel, and a second fantasy player picks a name and the user's fantasy team name on the back panel.

Alerts including flashing lights and audio messages are made when the first or second fantasy player scores or makes a significant play. The alerts are also made when the user's fantasy team members score or make a significant play. The fantasy team score is audio-announced at the change of quarters, innings, or another standard game interval. In yet another embodiment, the smartphone app upon user request will display the fantasy team roster with the stats for each player for the current game and a compilation of the season stats for each player on the fantasy team with a ranking against other fantasy team players in the fantasy league.

A user smartphone app that receives live sports news 1120. A plurality of illumination devices, for example, LED lights, integrated into the sports jersey shirts and sports clothing to flash when a sports jersey displays team scores 1130. The plurality of illumination devices are configured to flash a first color when the first sports team scores and to flash a second color when the second sports team scores, based on the mobile app transmitted alerts of sports team events activation of sensors dedicated to turning on a color for a predetermined time. A processor with digital memory is used to determine player performance and scoring events for user fantasy sports points 1140.

A processor with digital memory to determine user fantasy sports scoring based on player performance and scoring events 1150. A plurality of speakers integrated into the sports jersey shirts and sports clothing to announce when a sports jersey displayed team scores 1160. In one embodiment, the smartphone app can play for predetermined events, for example, music with a familiar sports cheer for example "charge" 1162.

In another example, the user selects prerecorded videos and music to play in a fantasy half-time show on the smartphone app. The smartphone app facilitates the user to manage their chosen fantasy team players. For example, the user can select a starting pitcher, a starting quarterback, a starting hockey goalie, or a starting forward on a soccer team and substitute during the game or match. The smartphone app facilitates the user-manager to make fantasy free-agent pickups and trades.

A fantasy sport is a game, played using the Internet, where fantasy sport participants assemble imaginary or virtual teams composed of proxies of real players of at least one professional sport. The outcome of a fantasy game is determined by the actual results of a player's performance in real live professional sports events. In fantasy sports, as in real sports, fantasy sports participant team owners can draft, trade, and cut players of one embodiment.

Figure 12:
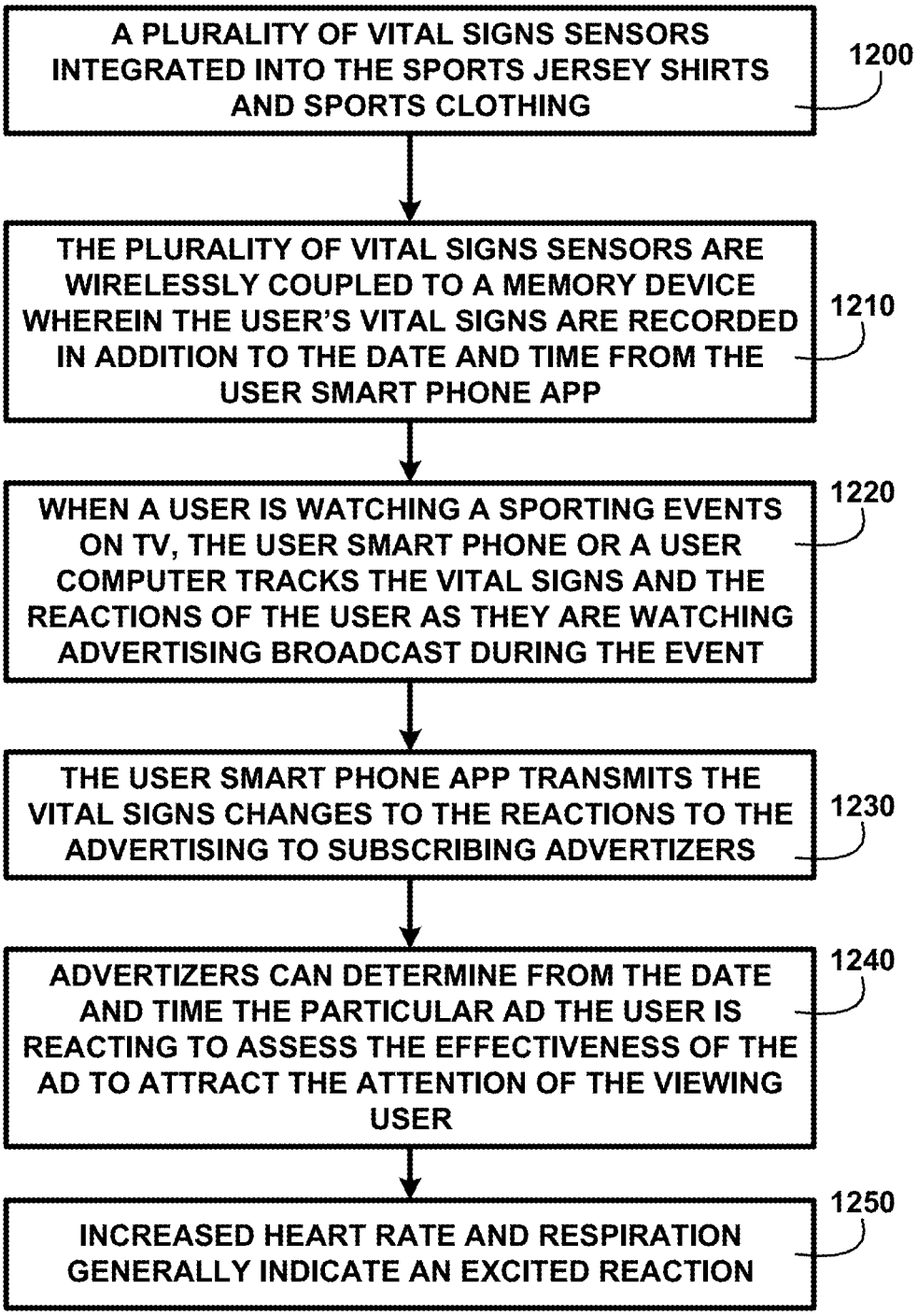
FIG. 12 shows a block diagram of an overview of multi-team sports jersey shirts and clothing advertising of one embodiment.

FIG. 12 shows a block diagram of an overview of multi-team sports jersey shirts and clothing advertising of one embodiment. FIG. 12 shows a plurality of vital signs sensors integrated into the sports jersey shirts and sports clothing 1200. The plurality of vital signs sensors are wirelessly coupled to a memory device wherein the user's vital signs are recorded in addition to the date and time from the user's smartphone app 1210. When a user is watching a sporting event on TV, the user's smartphone or a user's computer tracks the vital signs and reactions of the user as they are watching an advertising broadcast during the event 1220.

The user smartphone app transmits the vital signs changes to the reactions to the advertising to subscribing advertisers 1230. Advertisers can determine from the date and time the particular ad the user is reacting to assess the effectiveness of the ad to attract the attention of the viewing user 1240. Increased heart rate and respiration generally indicate an excited reaction 1250 by the user. Sports advertising has taken on its importance. Advertisers pay large sums of money to place ads, for example, Super Bowl ads. Viewers are watching, in some cases, just to see the ads. The user's reactions are a judge of the ad presentation since the multi-team sports jersey shirts and clothing wearer is an obvious sports enthusiast who will frequently be viewing the ads of one embodiment.

Figure 13:
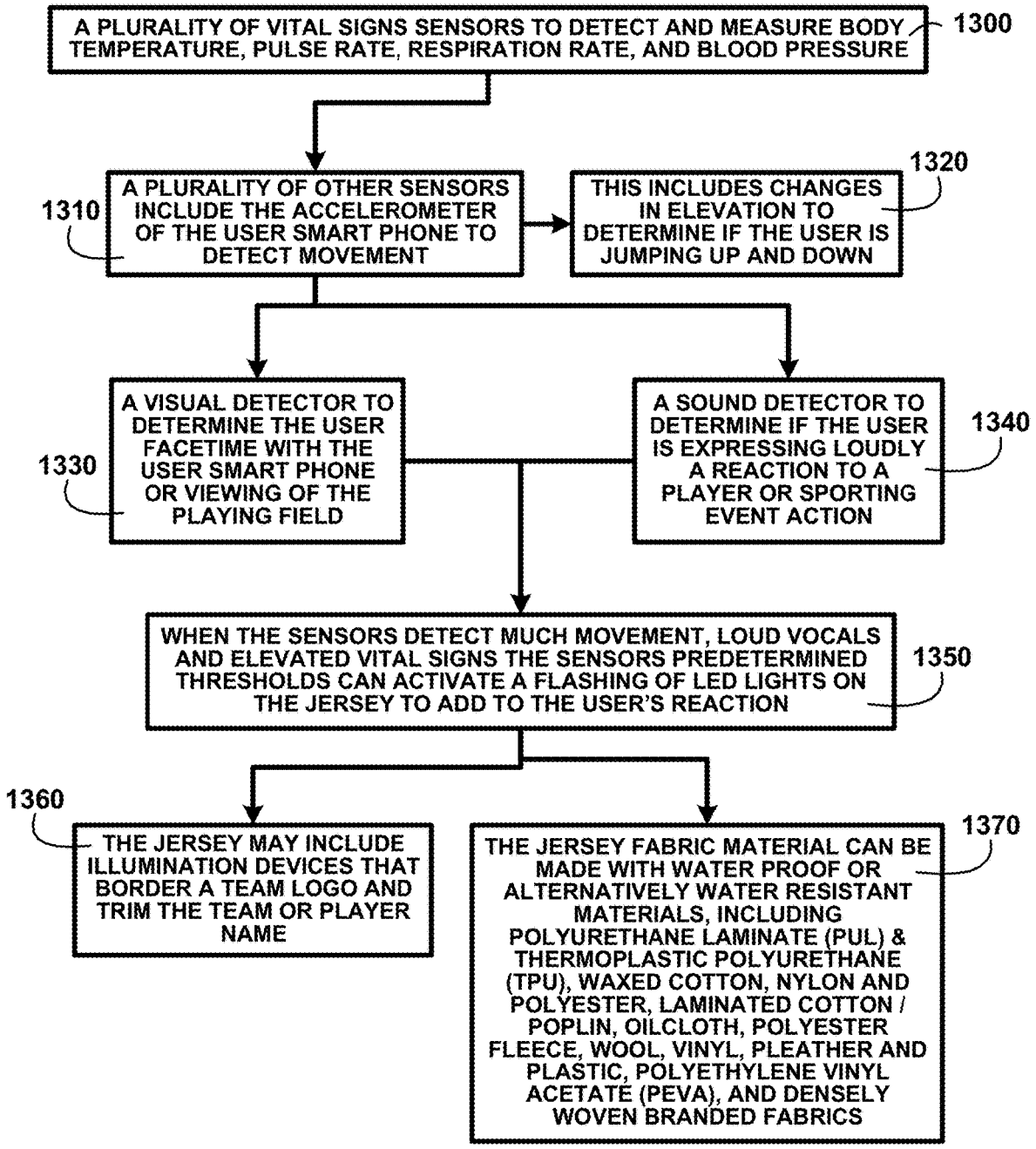
FIG. 13 shows a block diagram of an overview of multi-team sports jersey shirts and clothing vital signs sensing one embodiment.

FIG. 13 shows a block diagram of an overview of multi-team sports jersey shirts and clothing vital signs sensing of one embodiment. FIG. 13 shows a plurality of vital signs sensors to detect and measure body temperature, pulse rate, respiration rate, and blood pressure 1300. A plurality of other sensors includes the accelerometer of the user's smartphone to detect movement 1310. This includes elevation changes to determine if the user is jumping up and down 1320. A visual detector to determine the user's face time with the user's smartphone or viewing of the playing field 1330 tracks the user's eye movements. A sound detector used to determine if the user is expressing loudly a reaction to a player or sporting event action 1340.

When the sensors detect much movement, loud vocals, and elevated vital signs the sensors' predetermined thresholds can activate a flashing of illumination devices on the jersey to add to the user's reaction 1350. The jersey may include illumination devices that border a team logo and trim the team or player name 1360. The jersey fabric material can be made with waterproof or water-resistant materials, including Polyurethane Laminate (PUL) & Thermoplastic Polyurethane (TPU), waxed cotton, nylon and polyester, laminated cotton/poplin, oilcloth, polyester fleece, wool, vinyl, pleather and plastic, polyethylene vinyl acetate (PEVA), and densely woven branded fabrics 1370.

Waterproof and water-resistant fabrics prevent rain from short-circuiting digital and electronic sensors, illumination devices, and other electrical components. A mobile app wirelessly coupled to a plurality of sensors to transmit alerts to a user from the mobile app via the plurality of sensors. In one embodiment, a plurality of illumination devices integrated into the sports jersey shirts and sports clothing is configured to flash when a sports jersey displays team-related events.

Figure 14:
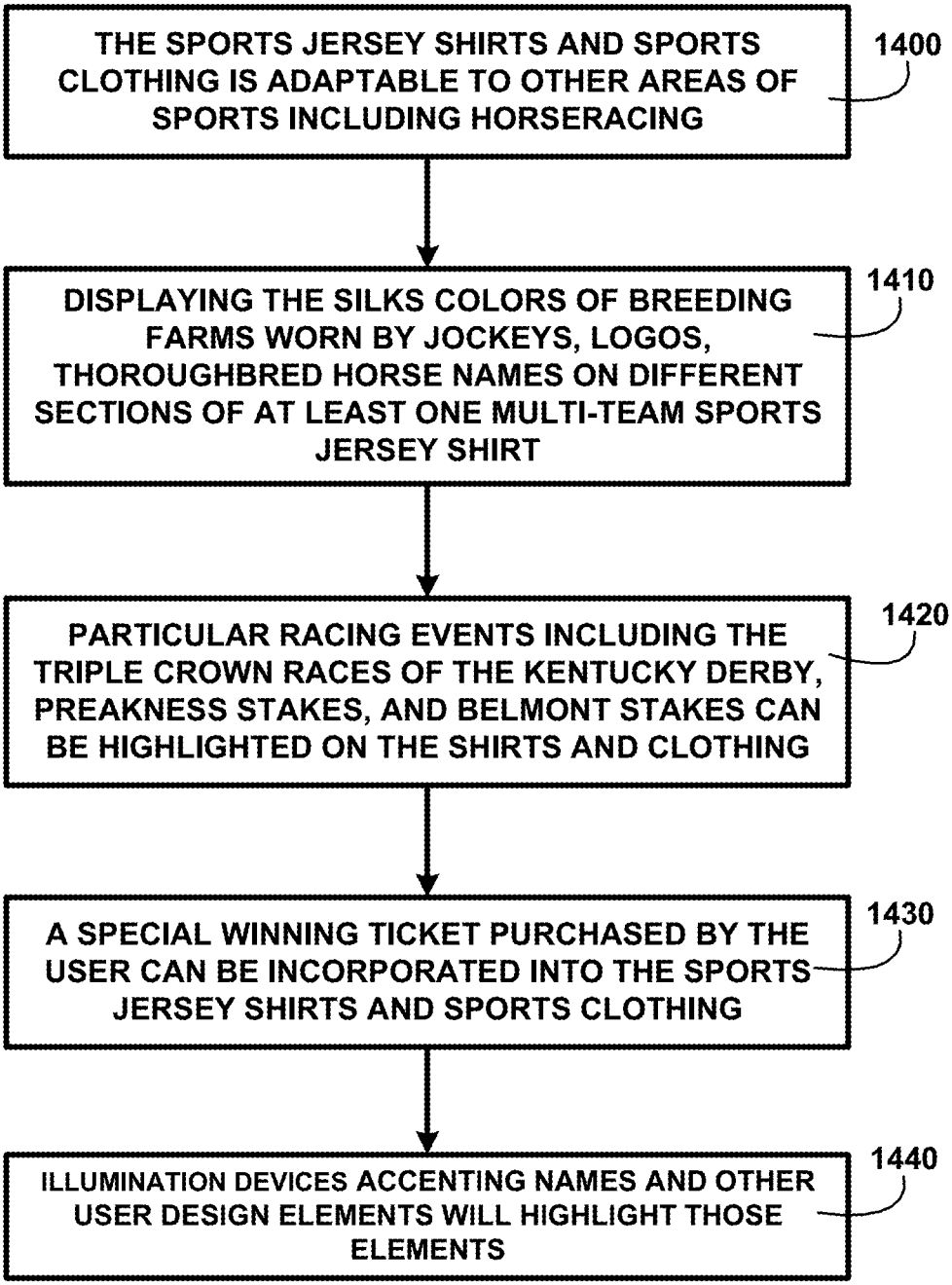
FIG. 14 shows a block diagram of an overview of multi-team sports jersey shirts and clothing horseracing applications of one embodiment.

FIG. 14 shows a block diagram of an overview of multi-team sports jersey shirts and clothing horseracing applications of one embodiment. FIG. 14 shows that sports jersey shirts and sports clothing are adaptable to other areas of sports including horseracing 1400. Other areas of sports include hockey, rugby, cricket, bowling, racecar events, and sports fishing.

In this example of horseracing, the sports jersey shirts and sports clothing can display the silks colors of breeding farms worn by jockeys, logos, and thoroughbred horse names on different sections of at least one multi-team sports jersey shirt 1410. Particular racing events including the triple crown races of the Kentucky Derby, Preakness Stakes, and Belmont Stakes can be highlighted on the shirts and clothing 1420. The user may want to display a special winning ticket purchased by the user that can be incorporated into the sports jersey shirts and sports clothing 1430. Illumination devices accenting names and other useful design elements will highlight those elements 1440 of one embodiment.

Figure 15:
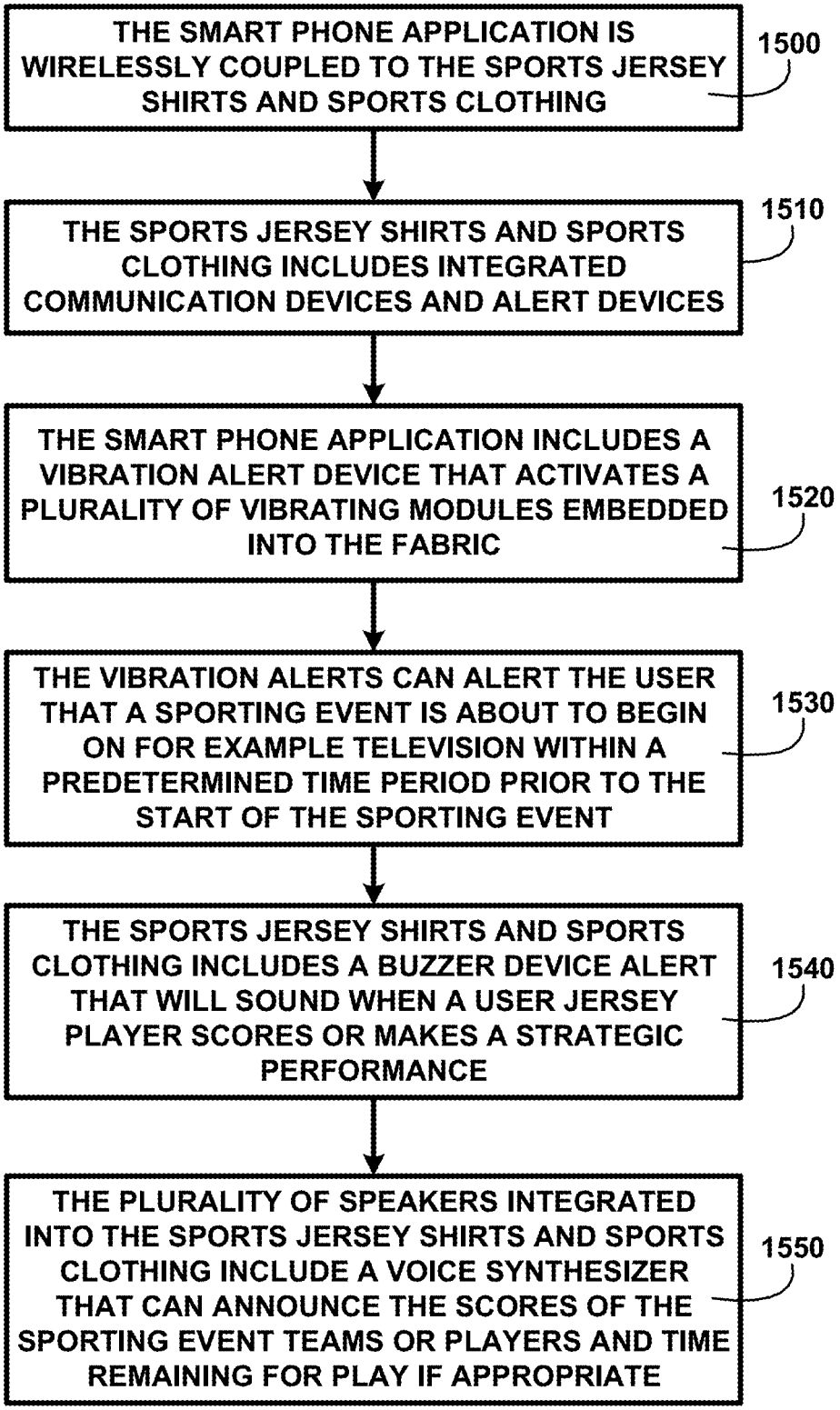
FIG. 15 shows a block diagram of an overview of multi-team sports jersey shirts and clothing alerts of one embodiment.

FIG. 15 shows a block diagram of an overview of multi-team sports jersey shirts and clothing alerts of one embodiment. FIG. 15 shows the smartphone app is wirelessly coupled to the sports jersey shirts and sports clothing 1500. The sports jersey shirts and sports clothing include integrated communication devices and alert devices 1510. The smartphone app includes a vibration alert device that activates a plurality of vibrating modules embedded into the fabric 1520. The vibration alerts can alert the user that a sporting event is about to begin on, for example, television within a predetermined time before the start of the sporting event 1530.

The sports jersey shirts and sports clothing include a buzzer device alert that will sound when a user jersey player scores or makes a strategic performance 1540. The plurality of speakers integrated into the sports jersey shirts and sports clothing includes a voice synthesizer that can announce the scores of the sporting event teams or players and time remaining for play if appropriate 1550.

Figure 16:
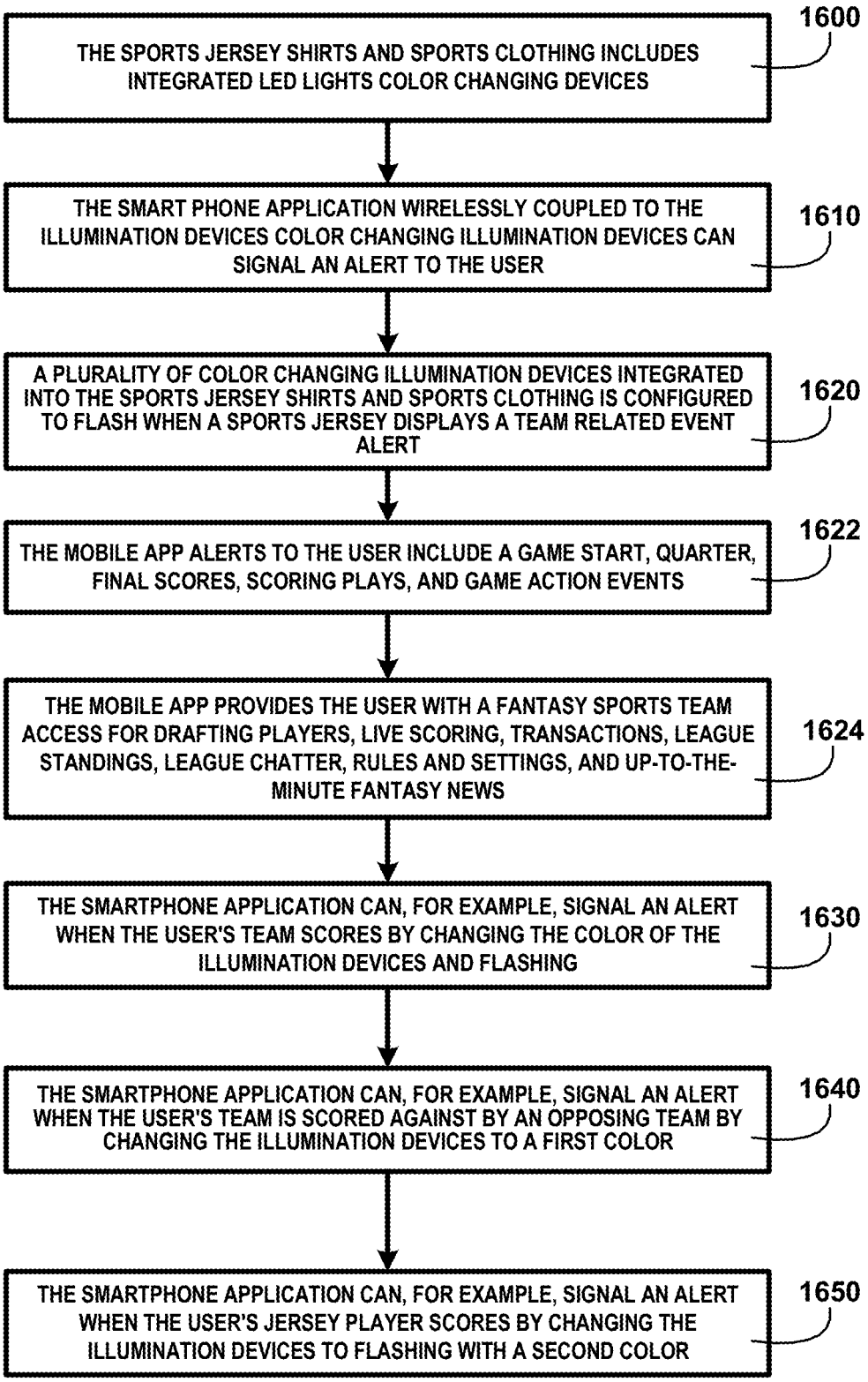
FIG. 16 shows a block diagram of an overview of multi-team sports jersey shirts and clothing color-changing illuminating devices of one embodiment.

FIG. 16 shows a block diagram of an overview of multi-team sports jersey shirts and clothing color-changing illuminating devices of one embodiment. FIG. 16 shows the sports jersey shirts and sports clothing include integrated color changing illumination devices 1600. The smartphone app wirelessly coupled to the color-changing illumination devices can signal an alert to the user 1610.

A plurality of color-changing illumination devices integrated into the sports jersey shirts and sports clothing is configured to flash when a sports jersey displays a team-related event alert 1620. The mobile app alerts the user including a game start, quarter, and final scores, scoring plays, and game action events 1622. In another embodiment, the mobile app provides the user with a fantasy sports team access for drafting players, live scoring, transactions, league standings, league chatter, rules and settings, and up-to-the-minute fantasy news 1624.

The smartphone application can, for example, signal an alert when the user's team scores by changing the color of the illumination devices and flashing 1630. The smartphone application can, for example, signal an alert when the user's team is scored against by an opposing team by changing the illumination devices to a first color 1640. The smartphone application can, for example, signal an alert when the user's jersey player scores by changing the illumination devices to flashing with a second color 1650.

Figure 17:
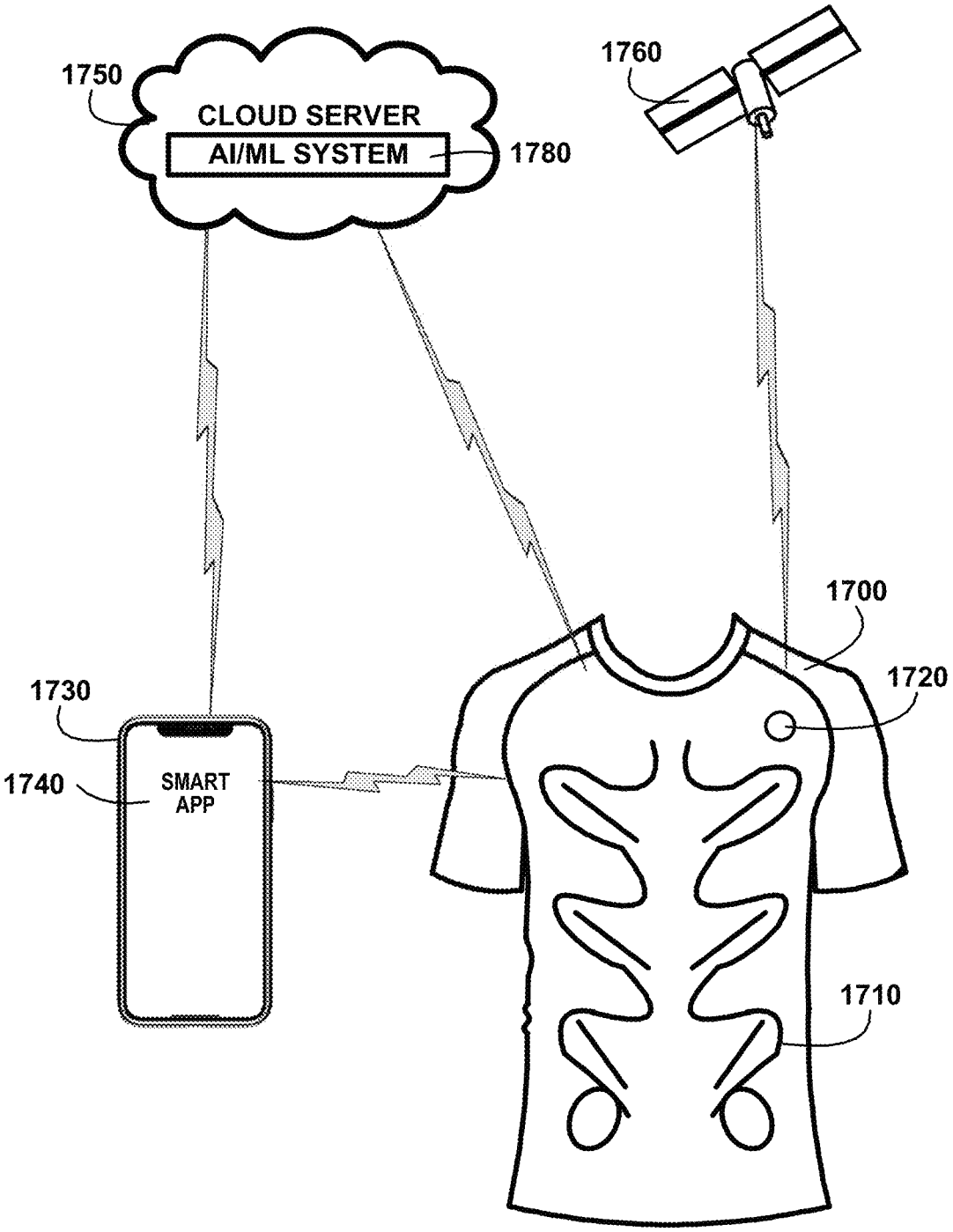
FIG. 17 shows for illustrative purposes only an example of a smart clothing operation system of one embodiment.

FIG. 17 shows for illustrative purposes only an example of a smart clothing operation system of one embodiment. FIG. 17 shows a piece of smart clothing 1700 that has connected actuators or activation devices 1710, which in one embodiment is a fiber optic pattern. The smart clothing 1700 also has a plurality of sensors 1720 coupled to or integrated within the fabric of the smart clothing 1700. A user's mobile device 1730 has a smart app 1740 installed. The smart app 1740 communicates with a cloud server AI-ML system 1780 to store data being received from the smart clothing 1700 and smart app 1740. A GPS satellite 1760 transmits the GPS location of the smart clothing 1700. The smart clothing 1700 GPS location is tracked, and the GPS location coordinates are sent to the user's mobile device 1730 for storage in the cloud server AI-ML 1750.

The plurality of sensors 1720 detects and transmits to the user smart app 1740 data including the user's vital signs, temperature, and humidity both inside the smart clothing 1700 and the outside environment. The plurality of sensors 1720 detects and transmits to the user smart app 1740 the charge level of the battery that powers the smart clothing 1700. The transmitted battery charge level is displayed on the user smart app 1740 to alert the user when the battery needs recharging. The plurality of sensors 1720 also tracks the operating status of the illuminated fiber optics to gather data on any operational problems and after that, the data is sent to the cloud server AI-ML 1750 where it processes the data to determine suggestions on correcting the problems.

The communication between the smart app 1740 and the smart clothing 1700 uses Bluetooth® protocols to maintain a constant connection. The smart clothing 1700 includes the smart app 1740, which transmits ping instructions to build a heartbeat bridge with the smart app 1740 to create continuous communication of one embodiment.

Figure 18:
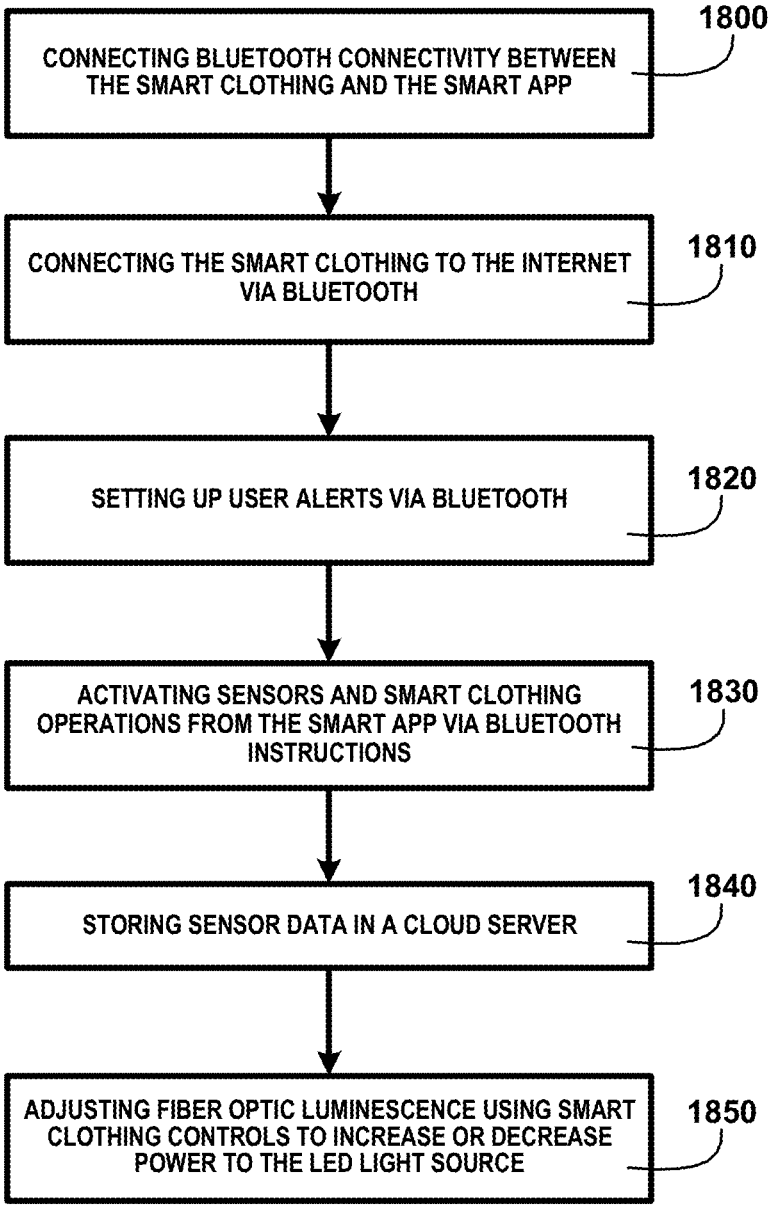
FIG. 18 shows a block diagram of an overview flow chart of the smart clothing of one embodiment.

FIG. 18 shows a block diagram of an overview flow chart of the smart clothing of one embodiment. FIG. 18 shows connecting Bluetooth® connectivity between the smart clothing and the smart app 1800 to maintain a constant connection. Connecting the smart clothing to the internet via Bluetooth® 1810. The user setting up user alerts via Bluetooth® 1820 provides constant ability to receive in real time the alert messages. The user is activating sensors and smart clothing operations from the smart app via Bluetooth® instructions 1830. Storing sensor data in a cloud server 1840 is done using an artificial intelligence and machine learning system. Adjusting fiber optic luminescence using smart clothing controls to increase or decrease the power to the LED light source 1850.

In one embodiment, the cloud server 1750 of FIG. 17 includes an artificial intelligence (AI) and machine learning (ML) system 1780 of FIG. 17 that interacts with the user through the smart app 1740 of FIG. 17 and smart clothing 1700 of FIG. 17. In another embodiment, AI, and ML system 1780 of FIG. 17 can be incorporated in the cloud server 1750 of FIG. 17 and/or the smart app 1740 of FIG. 17 and/or the smart clothing 1700 of FIG. 17. The AI and ML system 1780 of FIG. 17 collects and gathers static data, such as known data about certain locations, user preferences etc., and dynamic data, such as real-time data collected by the sensors 1720 of FIG. 17 that may change or be collected at any time.

The user may communicate and interact in real-time with the AI and ML system 1780 of FIG. 17 using natural language (text or speech) to provide voice commands and receive responses, suggestions, or answers in real-time via the smart app 1740 of FIG. 17 of the mobile device 1730 of FIG. 17 or directly through the smart clothing 1700 of FIG. 17. If directly through the smart clothing 1740 of FIG. 17, the sensors 1720 of FIG. 17 of the smart clothing can include a microphone and the actuation device 1710 of FIG. 17 can be a speaker to allow the user to interact with the smart clothing 1700 of FIG. 17 by speaking directly into the microphone to interact with the AI and ML system 1780 of FIG. 17.

The AI and ML system can be any suitable neural network learning device, such as a Bayesian network, a collaborative filtering system, a content-based filtering system, a hybrid recommendation system, a neural networks for deep learning, a knowledge-based system, an autoencoder and matrix factorization system, a federated learning system, or a graph-based recommendation system.

The AI and ML system 1780 of FIG. 17 continuously communicates automatically with the smart app by recording the user's selections of preferences of the color and illumination action. For example, the user selects the first (left) color and flashing more than the other options. The AI and ML system 1780 of FIG. 17 learns the user's preference for that color and illumination. The AI and ML system 1780 of FIG. 17 also records the duration the user typically leaves each color selected and each type of illumination on.

The AI and ML system 1780 of FIG. 17 can also record the sensor data of the user's vital signs including temperature, heart rate, blood pressure, and respiration rate. When the user shows an increase in, for example, heart rate and motion detected by changes in the user's smart clothing GPS location, the AI and ML system 1780 of FIG. 17 records the operations of the smart clothing 1700 of FIG. 17 as a user preference during those conditions, the sensors include proximity sensors on the front, back, and both sides of the smart clothing 1700 of FIG. 17.

The proximity sensors can detect when the user is in a crowd, a small group, or when very few or no persons are near the user. The proximity sensing data is recorded to learn what smart clothing 1700 of FIG. 17 operation the user has selected during those conditions. Sound sensors located on the smart clothing 1700 of FIG. 17 detect when, for example, the user is in a quiet area versus an event, for example, a sporting event. This is recorded and learns what smart clothing 1700 of FIG. 17 operating preferences the user has selected in the different settings.

The AI and ML system 1780 of FIG. 17 also automatically captures vocals and voice when the user speaks with others. The user's preferences are recorded with the smart clothing microphone to learn of the user's favorite sports team, entertainer, music, and other user-selected choices. The learned AI and ML system 1780 of FIG. 17 user preferences of the smart clothing 1700 of FIG. 17 operations based on the user's GPS location, surroundings, activity, vital sign reactions, and user-selected modes of smart clothing 1700 of FIG. 17 operations are automatically activated in each of the learning occasions. Should the user announce via the smart clothing microphone to stop an automatically activated smart clothing 1700 of FIG. 17 operation the AI and ML system 1780 of FIG. 17 will stop the smart clothing 1700 of FIG. 17 operation.

The AI and ML system 1780 of FIG. 17 can determine through the sensor data being received at that time under what conditions the user does not prefer the activation of those smart clothing 1700 of FIG. 17 operations. The AI and ML system 1780 of FIG. 17 learns the overall preferences through the user interaction when and under what conditions the user actually prefers the use of the smart clothing 1700 of FIG. 17 options to assist the user in the appropriate enjoyment of the smart clothing 1700 of FIG. 17 illumination operations of one embodiment.

Figure 19:
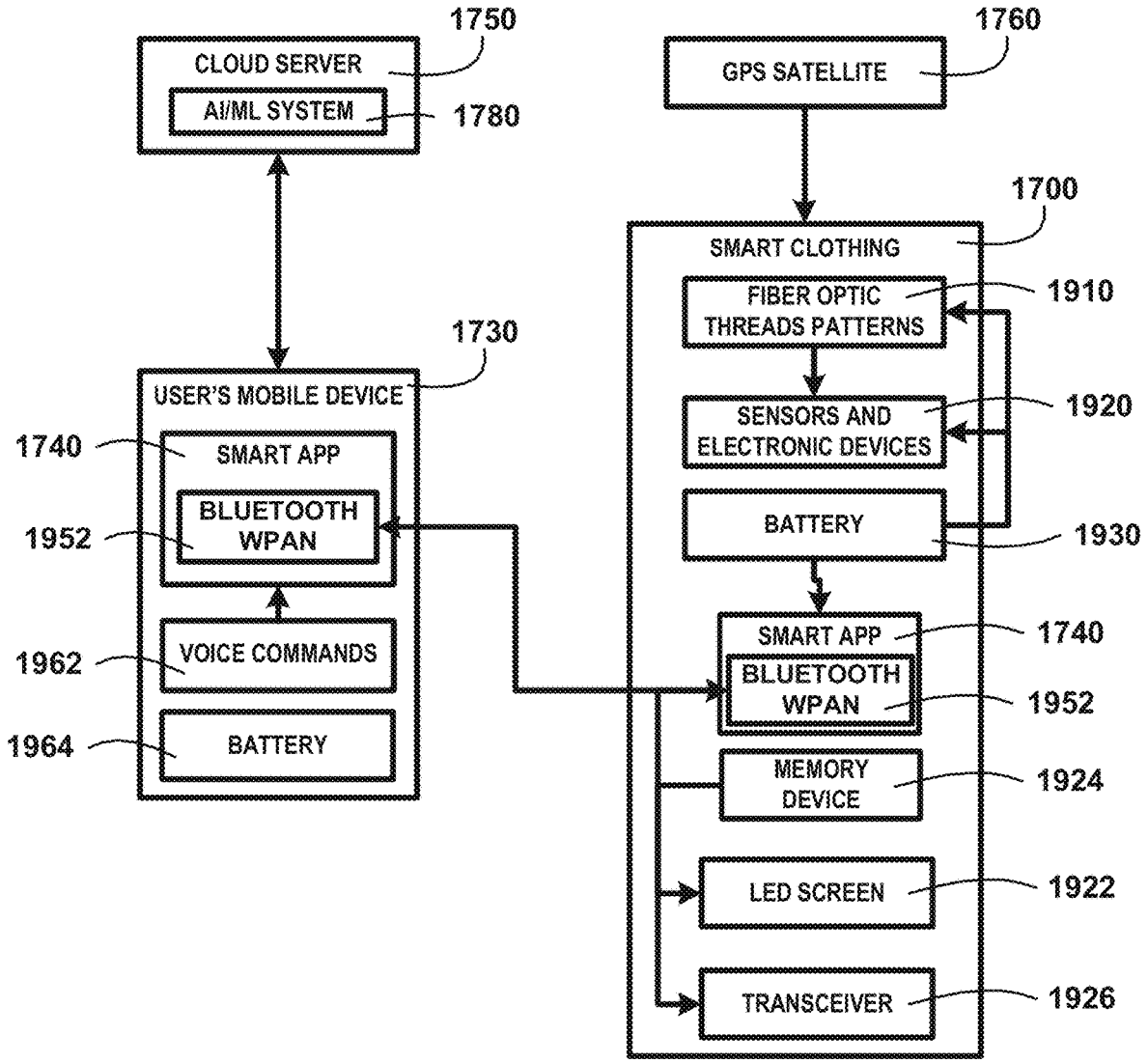
FIG. 19 shows a block diagram of an overview of the smart clothing devices and systems of one embodiment.

FIG. 19 shows a block diagram of an overview of the smart clothing devices and systems of one embodiment. FIG. 19 shows the smart clothing 1700 that includes at least trousers, shorts, hats, caps, smart jersey shirts, warm-up suits, and sweat suits. A plurality of fiber optic threads patterns 1910 are connectable to the smart clothing 1700.

Also coupled to the smart clothing 1700 are sensors and electronic devices 1920, at least one battery 1930, a wireless controller, a microphone, a speaker, a smart app 1740, Bluetooth® WPAN 1952 (Wireless Personal Area Network) software to provide Bluetooth® protocols, a memory device 1924, and a transceiver 1926.

In one embodiment, an LED screen 1922 is coupled to the smart clothing 1700. The smart clothing 1700 is wirelessly connected to a user's mobile device 1730 having the smart app 1740. The smart app 1740 includes a Bluetooth® WPAN 1952 (Wireless Personal Area Network). The user's mobile device 1730 having the smart app 1740 allows the user to use voice commands 1962 to operate the smart clothing 1700. The user's mobile device 1730 includes a battery 1964 to power the mobile device and smart app 1740. On the smart clothing 1700 the smart app 1740 receives from a GPS satellite 1760 the GPS location of the smart clothing 1700 and transmits the GPS location to the user's mobile device 1730. The user's mobile device 1730 smart app 1740 stores the GPS location to the cloud server 1750. If lost or stolen the user may search the cloud server 1750 for the current GPS location for recovery.

The Bluetooth® WPAN 1952 provides Bluetooth® protocols between the smart clothing 1700 and the user's mobile device 1730 and smart app 1740. The Bluetooth® protocols include smart jersey app and wireless controller communicating by basic data frames. Both the smart jersey app and the wireless controller communicate using Bluetooth® protocol to generate and receive the data frames.

The wireless controller 1940 uses the Bluetooth® protocol in each session, the Bluetooth® protocol device will generate a random token. The smart app 1740 and wireless controller communication by basic data frames. The smart app 1740 and Bluetooth® protocol device communicate by basic data frames with data frame encryption. The wireless controller sends ping instructions to build a heartbeat bridge with the smart jersey app to create continuous communication. The ping instructions include enabling ping, disable ping, set ping cycle, and ping notification. The ping instructions are used to reset device, get battery level, and lock the device. The ping instructions are also used to adjust luminance, for example, update color, blink, breath, and start a multi-color flash of one embodiment.

In the Bluetooth® protocol, a ping signal is a low-level mechanism used to check connectivity between devices, ensuring that the connection is still alive, especially in idle states. This is often used in Bluetooth® Low-Energy (BLE) devices to conserve power while maintaining a connection. The ping signal ensures that the link between two Bluetooth® devices is active without requiring data transmission. It is primarily used for link supervision to avoid connection loss when devices are idle or in a low-power mode.

The connection is managed by sending via the transceiver 1926 empty packets or small, simple packets at regular intervals to check if the devices can still "hear" each other. This ping is typically done by sending a LL_PING_REQ (Link Layer Ping Request) from the master device (the mobile phone in most cases) to the slave or peripheral device. The peripheral device responds with a LL_PING_RSP (Link Layer Ping Response) to indicate the connection is still healthy.

BLE devices often enter low-power modes when not actively transmitting data. The ping mechanism helps maintain the connection without consuming a lot of power. If no ping response is received within a certain timeout (link supervision timeout), the connection is considered lost, and the Bluetooth® stack will attempt to re-establish the connection or disconnect.

Bluetooth® Communication when the wireless controller communicates with a mobile device via the smart jersey app, the app initiates a connection with the wireless controller by scanning for available BLE devices. Once the wireless controller is discovered, a connection is established by exchanging advertising packets that provide basic information about the device (name, services, etc.). The mobile app will access specific services and characteristics on the BLE device to read or write data. During data exchange, ping signals may occur to ensure the connection remains stable if the device is idle.

In one embodiment, an LED screen 1922 may be sewn into the smart clothing 1700. An LED screen 1922 that is processed to sew into the smart clothing. The wireless controller includes a memory device 1924 to store a plurality of short video productions. The plurality of short video productions may include, for example, game highlights, advertising, and a weather report when the user is attending an outdoor event of one embodiment.

An LED screen to be attached to clothing is a lightweight, flexible display that integrates seamlessly into the fabric. LED screens can be sewn or fastened onto garments and are made with flexible circuits to ensure comfort and mobility. Powered by small, rechargeable batteries, they allow for dynamic, customizable visuals such as text, patterns, or animations. Commonly used for fashion, marketing, or safety applications, these wearable LED screens bring innovation to personal expression and interactive experiences. They are controlled via the smart app 1740, enabling users to easily change the display on the go.

In one embodiment, the smart clothing 1700 is created for pets and animals. For example, a smart clothing 1700 for a pet dog. The smart clothing, in one example, could be a thermal dog coat outfitted with a fiber optic pattern customized by the dog owner. The dog owner could select an illumination, in one example, for at night to be able to better locate the dog in the dark. In another example, the smart thermal dog coat may include a speaker allowing the owner to give voice commands even if the dog was too far away to hear a normal voice command without communication advantage. The smart thermal dog coat also has GPS location capabilities to allow the owner to determine where the dog had gone.

In one embodiment, a smart clothing 1700 do-it-yourself kit may be provided to allow a user to be easily assembled onto a favorite Sports Jersey. This would be for users that already have a jersey or may have a favorite customized jersey from a player that has already retired.

In another embodiment, smart clothing 1700 is customized for the user who, for example, is a prominent sports figure or an entertainment personality. The user may select the fiber optic patterns, colors, and other adaptations to fit the purpose, for example, gifts, promotional materials, and other purposes.

In yet another embodiment, a user may receive requested alerts and notifications that would be constantly available to receive on the smart app 1740 via the constant connectivity of the Bluetooth® protocols internet connection. The alerts and notifications mode may be selected by the user as a text message, a visual on the user's mobile device, and/or audible alerts and notifications.

In one embodiment, a licensee using the smart app 1740 in remote mode to control the fiber optic operations of the smart clothing 1700 of multiple other users. A licensee using the smart app 1740 in remote mode may control other users' wireless controllers set to remote mode on the smart app 1740. Each user is wearing smart clothing 1700 and has a mobile device 1730 and the licensee has a master mobile device set in remote mode. The other users have been instructed to switch to remote mode as well. The licensee makes a selection to, for example, illuminate the patterns on all the smart jerseys in the group to the left color in a blink. The master mobile device smart app 1740 communicates to the other user's mobile devices and the patterns on all the smart clothing 1700 blink in the left color. This identifies the members of the group who may prefer this master licensee control of one embodiment.

The foregoing has described the principles, embodiments, and modes of operation of the present invention. However, the invention should not be construed as being limited to the particular embodiments discussed. The above-described embodiments should be regarded as illustrative rather than restrictive, and it should be appreciated that variations may be made in those embodiments by workers skilled in the art without departing from the scope of the present invention as defined by the following claims.

What is claimed is:

1. A smart clothing system, comprising:

a piece of smart clothing having fabric;

a plurality of sensors integrated with the piece of smart clothing and coupled to the fabric of the smart clothing;

a plurality of actuation devices integrated with the piece of smart clothing and coupled to the sensors of the smart clothing;

a mobile device configured to wirelessly communicate via a Bluetooth® protocol with the plurality of sensors and the plurality of actuation devices of the smart clothing with bidirectional send and receive digital signals; and a smart application operating on the mobile device and having a voice command device, wherein the smart application is configured to provide status data of the plurality of sensors and the plurality of actuation devices, and the voice command device is configured to control the plurality of sensor and the plurality actuation devices.

2. The smart clothing system of claim 1, further comprising an artificial intelligence and machine learning system coupled to the smart application configured to collect static and dynamic data from the plurality of sensors and remote server and allow a user of the piece of smart clothing to interact with the smart clothing via the smart application.

3. The smart clothing system of claim 2, wherein the artificial intelligence and machine learning system is further configured to learn preferred settings and actions of the plurality of sensors and the plurality of actuation devices based on the static and the dynamic data to automatically control the plurality of sensors and the plurality of actuation devices.

4. The smart clothing system of claim 1, further comprising a transceiver coupled to the fabric of the smart clothing configured to send and receive static and dynamic data.

5. The smart clothing system of claim 2, wherein the artificial intelligence and machine learning system is further configured to convert the learned preferred settings into digital signal instructions to transmit to the smart clothing to actuate changes in the plurality of actuation devices settings.

6. The smart clothing system of claim 5, wherein the voice command device is further configured to allow the user to cancel artificial intelligence and machine learning system digital signal instructions to change the plurality of actuation device settings.

7. The smart clothing system of claim 1, wherein the plurality of sensors coupled to the fabric of the smart clothing include GPS sensors configured to determine the location of the smart clothing.

8. A smart clothing system, comprising:

a piece of smart clothing having fabric;

a plurality of sensors integrated with the piece of smart clothing and coupled to the fabric of the smart clothing;

a plurality of actuation devices integrated with the piece of smart clothing and coupled to the sensors of the smart clothing;

wherein the plurality of actuation devices includes a plurality of illumination devices integrated with the smart clothing;

a mobile device configured to wirelessly communicate via a Bluetooth® protocol with the plurality of sensors and the plurality of actuation devices of the smart clothing with bidirectional send and receive digital signals; and a smart application operating on the mobile device and having a voice command device, wherein the smart application is configured to provide status data of the plurality of sensors and the plurality of actuation devices, and the voice command device is configured to control the plurality of sensor and the plurality actuation devices.

9. The smart clothing system of claim 8, further comprising an artificial intelligence and machine learning system coupled to the smart application configured to collect static and dynamic data from the plurality of sensors and remote server and allow a user of the piece of smart clothing to interact with the smart clothing via the smart application.

10. The smart clothing system of claim 9, wherein the artificial intelligence and machine learning system is further configured to learn preferred settings and actions of the plurality of sensors and the plurality of actuation devices based on the static and the dynamic data to automatically control the plurality of sensors and the plurality of actuation devices.

11. The smart clothing system of claim 8, further comprising a transceiver coupled to the fabric of the smart clothing configured to send and receive static and dynamic data.

12. The smart clothing system of claim 9, wherein the artificial intelligence and machine learning system is further configured to convert the learned preferred settings into digital signal instructions to transmit to the smart clothing to actuate changes in the plurality of actuation devices settings.

13. The smart clothing system of claim 12, wherein the voice command device is further configured to allow the user to cancel artificial intelligence and machine learning system digital signal instructions to change the plurality of actuation devices settings.

14. The smart clothing system of claim 8, wherein the plurality of sensors coupled to the fabric of the smart clothing include GPS sensors configured to determine the location of the smart clothing.

15. A smart clothing system, comprising:

a piece of smart clothing having fabric;

a plurality of sensors integrated with the piece of smart clothing and coupled to the fabric of the smart clothing;

a plurality of actuation devices integrated with the piece of smart clothing and coupled to the sensors of the smart clothing;

wherein the plurality of actuation devices includes a plurality of illumination devices integrated with the smart clothing;

a plurality of fiber optic devices coupled to the fabric of the smart clothing;

a mobile device configured to wirelessly communicate via a Bluetooth® protocol with the plurality of sensors and the plurality of actuation devices of the smart clothing with bidirectional send and receive digital signals; and a smart application operating on the mobile device and having a voice command device, wherein the smart application is configured to provide status data of the plurality of sensors and the plurality of actuation devices, and the voice command device is configured to control the plurality of sensor and the plurality actuation devices.

16. The smart clothing system of claim 15, further comprising an artificial intelligence and machine learning system coupled to the smart application configured to collect static and dynamic data from the plurality of sensors and remote server and allow a user of the piece of smart clothing to interact with the smart clothing via the smart application.

17. The smart clothing system of claim 16, wherein the artificial intelligence and machine learning system is further configured to learn preferred settings and actions of the plurality of sensors and the plurality of actuation devices based on the static and the dynamic data to automatically control the plurality of sensors and the plurality of actuation devices.

18. The smart clothing system of claim 15, further comprising a transceiver coupled to the fabric of the smart clothing configured to send and receive static and dynamic data.

19. The smart clothing system of claim 16, wherein the artificial intelligence and machine learning system is further configured to convert the learned preferred settings into digital signal instructions to transmit to the smart clothing to actuate changes in the plurality of actuation devices settings.

20. The smart clothing system of claim 15, wherein the plurality of illumination devices includes at least one of the plurality of fiber optic devices configured to display colored lighting based on smart application commands.

* * * * *